US007165879B2

(12) United States Patent
Midas et al.

(10) Patent No.: US 7,165,879 B2
(45) Date of Patent: Jan. 23, 2007

(54) CLAMP LOCK APPARATUS AND METHOD FOR A PAINT MIXER

(75) Inventors: Thomas J. Midas, Oak Park Heights, MN (US); Brent Thomas Harrold, Burnsville, MN (US); William O. Gran, Shoreview, MN (US)

(73) Assignee: Red Devil Equipment Company, Plymouth, MN (US)

( * ) Notice: Subject to any disclaimer, the term of this patent is extended or adjusted under 35 U.S.C. 154(b) by 331 days.

(21) Appl. No.: 10/809,890

(22) Filed: Mar. 25, 2004

(65) Prior Publication Data

US 2005/0213426 A1 Sep. 29, 2005

(51) Int. Cl.
*B01F 11/00* (2006.01)

(52) U.S. Cl. ..... 366/209; 366/217; 366/605

(58) Field of Classification Search ..... 366/108–128, 366/208–217, 219, 605
See application file for complete search history.

(56) References Cited

U.S. PATENT DOCUMENTS

| | | | | | |
|---|---|---|---|---|---|
| 1,463,626 | A | * | 7/1923 | Marrazzo | 366/92 |
| 1,755,763 | A | * | 4/1930 | Barber | 366/213 |
| 2,599,833 | A | * | 6/1952 | Holmlund | 366/605 |
| 2,797,902 | A | * | 7/1957 | Beugler | 366/217 |
| 3,284,057 | A | * | 11/1966 | Duquette | 366/213 |
| 3,448,964 | A | * | 6/1969 | Wickes | 366/112 |
| 4,281,936 | A | * | 8/1981 | Schotter et al. | 366/209 |
| 4,415,270 | A | * | 11/1983 | Heinis et al. | 366/216 |
| 4,568,194 | A | * | 2/1986 | Gargioni | 366/213 |
| 4,619,532 | A | * | 10/1986 | Schmidt, III | 366/110 |
| 4,789,245 | A | * | 12/1988 | Morbeck | 366/217 |
| 4,834,548 | A | * | 5/1989 | Tempel et al. | 366/208 |
| 5,197,802 | A | * | 3/1993 | Miller et al. | 366/217 |
| 5,261,744 | A | * | 11/1993 | Brunn | 366/217 |
| 5,383,163 | A | * | 1/1995 | Brunn | 366/217 |
| 5,458,416 | A | * | 10/1995 | Edwards et al. | 366/209 |
| 5,711,601 | A | * | 1/1998 | Thomas et al. | 366/209 |

(Continued)

FOREIGN PATENT DOCUMENTS

WO 03/028873 A2 * 4/2003

OTHER PUBLICATIONS

Fluid Management; *Pro Mix; The heavy-duty gyroscopic mixer that's ideal for medium to high volume commercial applications*, 4 pages.

(Continued)

*Primary Examiner*—Charles E. Cooley
(74) *Attorney, Agent, or Firm*—Faegre & Benson LLP

(57) ABSTRACT

An improved paint mixer of the type rotating a paint container about a tumbling axis and a perpendicular spin axis, the improvements of a clamp assembly and lock, splash guards protecting a range-of-travel of upright clamp portions, low friction guide plates, an adjustable height strike plate and roller, a rigid gear assembly, an offset in the clamp to return the paint container to an upright position after mixing, and a relief in a raised portion on a lower plate of the clamp for assisting loading and unloading of the paint container.

45 Claims, 22 Drawing Sheets

U.S. PATENT DOCUMENTS

| | | | | |
|---|---|---|---|---|
| 5,788,371 | A * | 8/1998 | Neri et al. | 366/217 |
| 5,897,204 | A * | 4/1999 | Dittmer et al. | 366/209 |
| 7,059,763 | B1 * | 6/2006 | Sordelli et al. | 366/217 |
| 2005/0088911 | A1 * | 4/2005 | Sordelli et al. | 366/217 |
| 2005/0213426 | A1 * | 9/2005 | Midas et al. | 366/209 |
| 2005/0286341 | A1 * | 12/2005 | Midas et al. | 366/217 |

OTHER PUBLICATIONS

Hero Industrial Shakers; *automatic clamping and can release; High Speed Gyroscopic Paint Mixer*, 9 pages.

Red Devil Equipment Co.; 5020 5-Gallon Paint Mixer Owner's Manual.

* cited by examiner

CLAMP LOCK APPARATUS AND METHOD FOR A PAINT MIXER

BACKGROUND OF THE INVENTION

The present invention relates to the field of paint mixers of the type for mixing paint and related liquid coatings in conventional containers in the range of about 5 gallons or about 20 liters. More particularly, the present invention relates to such mixers which utilize gyroscopic mixing motion while the coating container is clamped between a pair of opposed plates. It is to be understood that such mixers are suitable for mixing coatings in the range of about 1 gallon to about 5 gallons (or the metric equivalent), and may be utilized to mix coatings in other than cylindrical containers, including, but not limited to so-called "square" containers, particularly when adapters or special shaped container holders are used.

In the past, one such mixer clamped the coating container by advancing one plate towards the other using a lead screw rotated by a hand wheel. While such an approach was generally satisfactory, the lead screw was prone to unscrewing during mixing, resulting in unintended partial or full release of the coating container, with consequent damage to the coating container and possibly the mixer. If the coating container was breached during such release, the coating would typically spill, contaminating the mixer and possibly the environment of the mixer. Such a result is naturally undesirable.

The present invention overcomes the shortcoming of the above described prior art mixer by providing a locking clamp for a gyroscopic type paint mixer which prevents the unintended release of the opposed plate clamp.

In another aspect, the above described prior art machine had a single traveling clamping screw attached to a handle and threaded through a stationary nut. Rotating the handle turned the screw and resulted in an axial displacement of the screw. In this prior art machine, the top clamping plate was attached to the screw and thus traveled up and down to clamp and unclamp the paint container.

The present invention also uses a single lead screw. However, in the present invention, the screw can rotate but is axially fixed. In the present invention, the screw is threaded through a nut which is free to travel axially but is fixed against rotation by rigidly mounting it to a cross member or bridge portion captured between two upright members or portions. By fixing the nut against rotation in the present invention (i.e. not allowing the nut to turn with the lead screw), the nut travels up and down when the screw is rotated, thus moving the top clamp plate to clamp and unclamp the paint container.

Another prior art gyroscopic type mixer used twin lead screws and two or more upright supports. In that prior art machine, turning the crank handle engaged a series of gears which rotated the twin lead screws. The lead screws were free to rotate but were fixed axially. The clamp plates were attached to cross-members that had threaded nuts fixed against rotation. In that prior art machine, turning the lead screws caused both the top and bottom clamp plates to move towards or away from each other to clamp or unclamp a paint container, in contrast to the present invention which moves only the top plate. The prior art machine which moves both plates simultaneously tended to keep the center of mass close to the tumble axis. In contrast, one aspect of the present invention permanently positions the center of mass below the tumble axis, allowing gravity to urge the rotating frame and paint container to stop in an upright position. Furthermore, the present invention greatly simplifies the design by requiring fewer parts in series in the clamping mechanism, with consequent reduction in cost and friction between operating parts.

Other aspects of the present invention include at least one splash guard for each range-of-travel portion for the movable part or parts of the clamping mechanism to prevent contamination with consequent increase in friction. A flange on the splash guard also acts as a stop to limit motion of the movable parts of the clamping mechanism at an end of the range-of-travel. In addition, the present invention includes at least one corresponding guide member to maintain the relationship between the fixed and moving parts of the rotatable clamp apparatus, with the guide member(s) formed of a polymer to reduce friction. Another aspect of the present invention is a strike plate located below a guide roller at a lower edge of a front opening of the mixer. The strike plate prevents the roller from denting the paint container as it is removed from the mixer, particularly when the container is metal. A still further aspect of the present invention is a relief formed in a raised lip on the lower clamp plate to aid in the transfer of the paint container into and out of the clamping apparatus. Yet another aspect of the present invention is to have a common base on which both a stationary sun gear and a planet gear (on the rotating clamp) are rigidly mounted, eliminating the play present with one prior art mixer design in which vibration mounts allowed the planet gear to "float" with respect to the sun gear, causing excessive misalignment and wear.

DETAILED DESCRIPTION OF THE INVENTION

Figure 1:
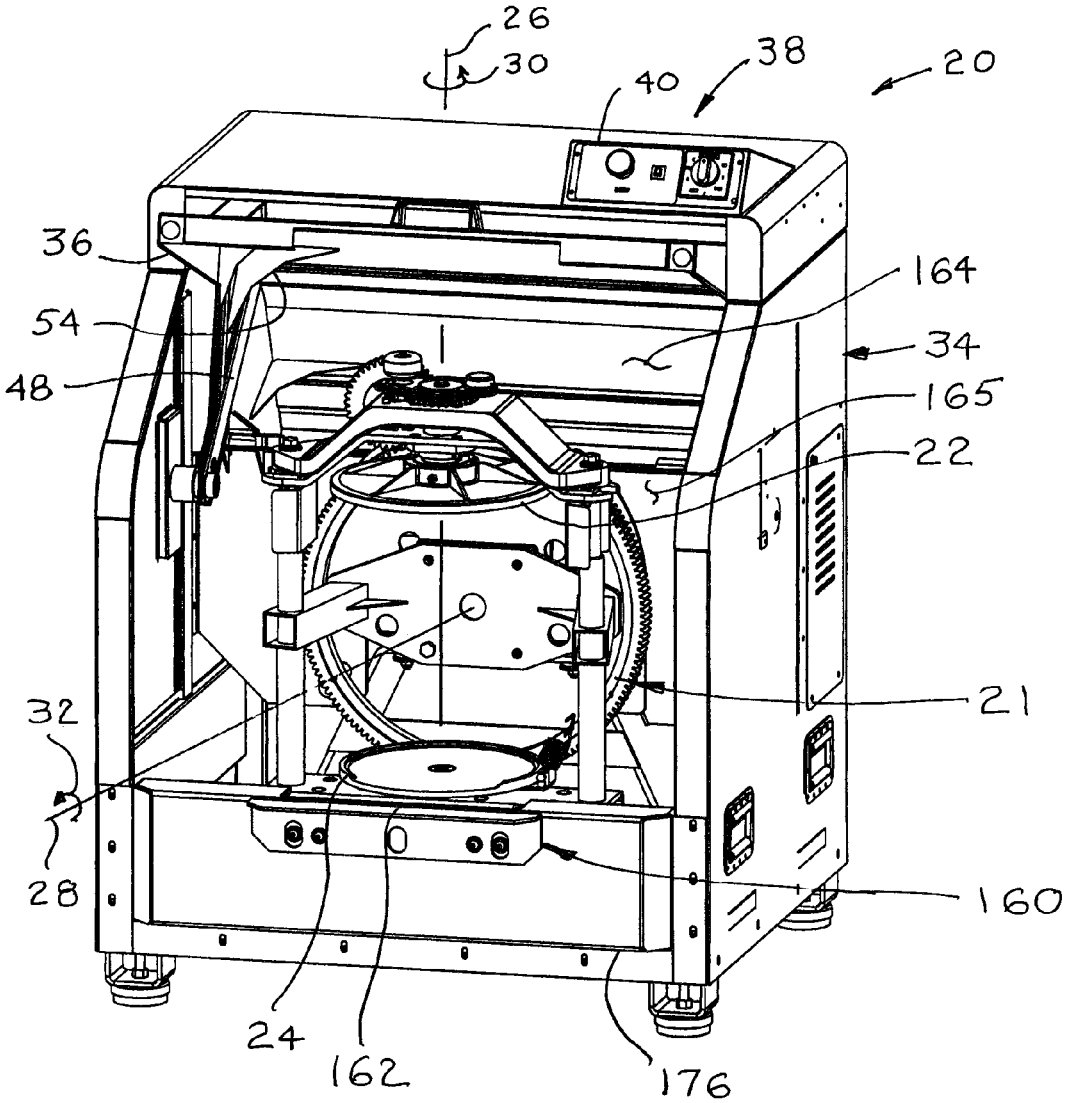
FIG. 1 is a perspective view of a mixer useful in the practice of the present invention, shown with a door open to illustrate certain features of the mixer.
Figure 2:
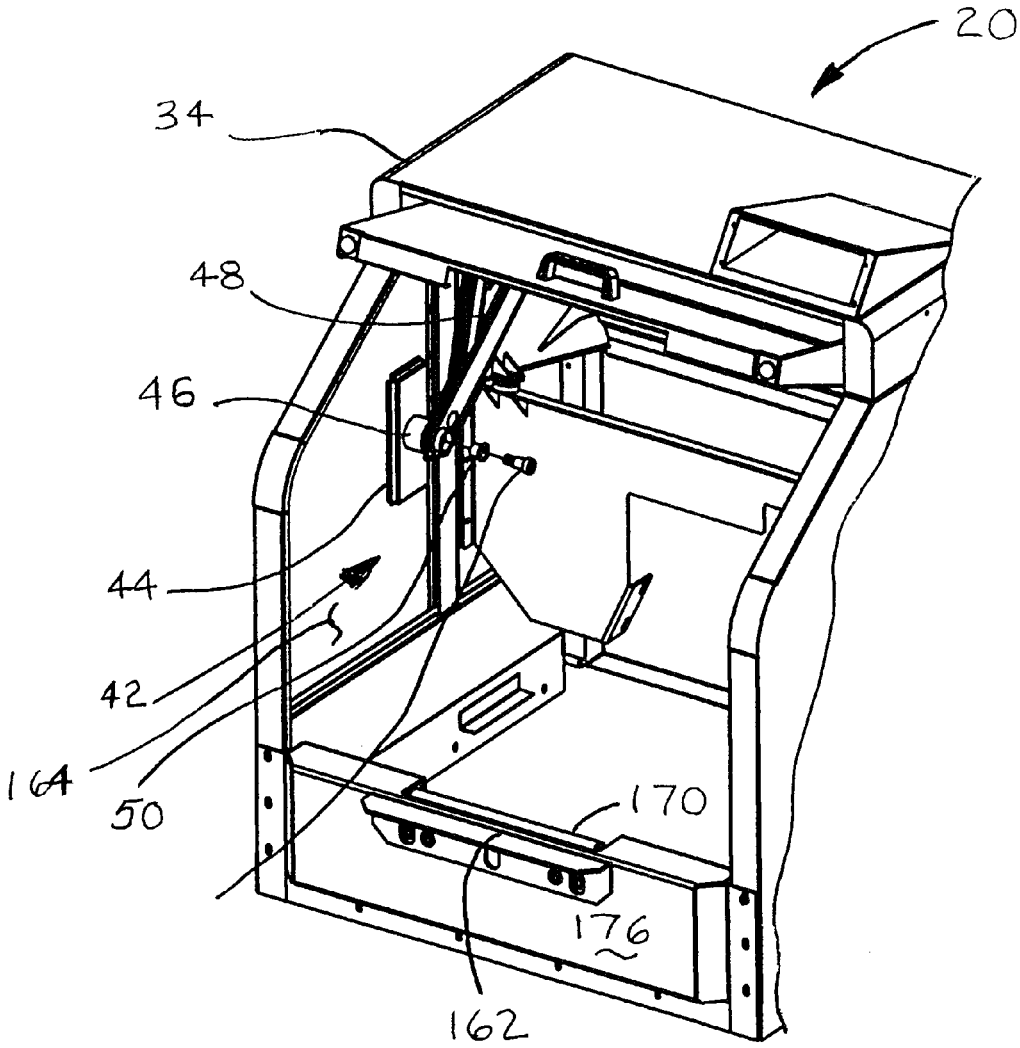
FIG. 2 is an enlarged fragmentary view of an enclosure of the mixer from FIG. 1 with parts omitted to illustrate certain features of the mixer.

Referring to the Figures, and most particularly to FIGS. 1 and 2, an improved paint mixer 20 may be seen. Mixer 20 is of the type having a clamping mechanism 21 which includes a rotatable frame 23 and a pair of opposed plates 22 and 24 sized and spaced to receive and clamp a conventional 5 gallon container of paint or similar coating material. In operation, mixer 20 will rotate the container about a pair of axes 26 and 28 as indicated by arrows 30 and 32. Mixer 20 has an enclosure 34 with a door 36, shown in an OPEN position in FIGS. 1 and 2. Suitable controls 38 may be mounted on a control panel 40 to start, stop and control the operation (e.g., timing) of the mixer 20.

As may be seen most clearly in FIG. 2, mixer 20 may have a single pivot point system 42 on each side (only one of which is shown) which improves alignment and durability of the door 36. System 42 includes a mounting pad 44 secured to the enclosure 34, and a boss 46 for pivotably receiving and supporting a door mounting arm 48 for pivoting movement thereabout. Arm 48 is pivotably secured to boss 46 via a bushing 50 and cap screw 52. Referring now again to FIG. 1, arm 48 is preferably secured to door 36 via one or more gussets 54.

Figure 3:
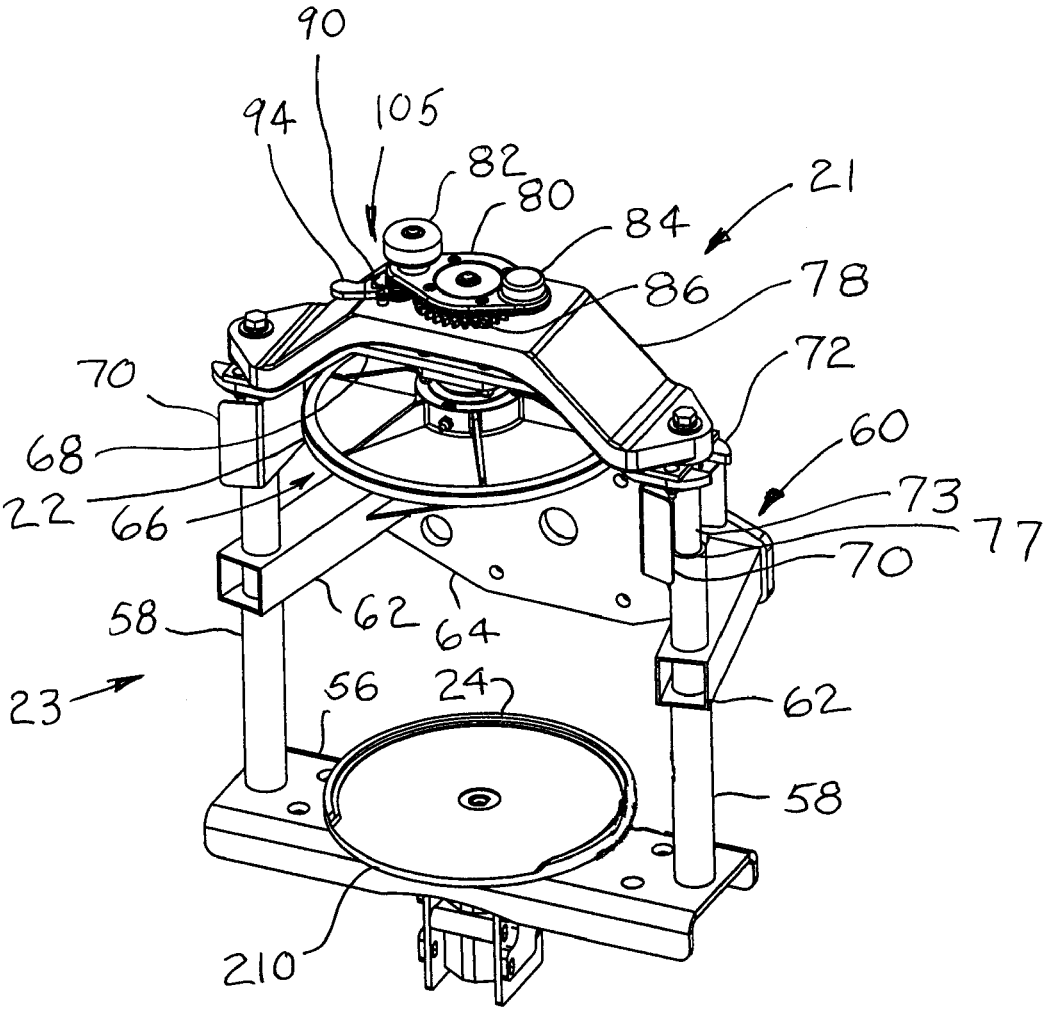
FIG. 3 is a perspective view of the clamping mechanism useful in the practice of the present invention.
Figure 4:
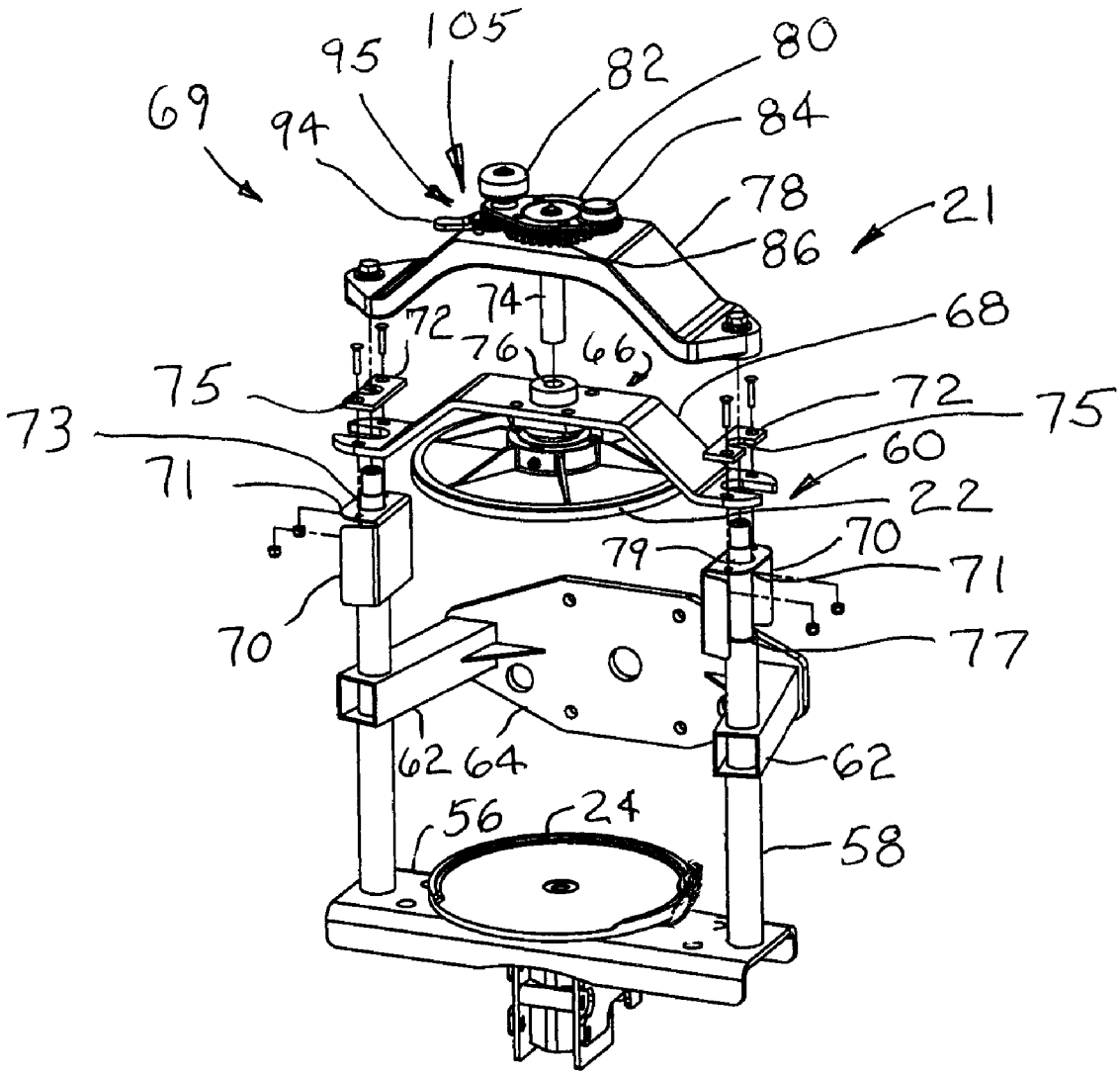
FIG. 4 is a fragmentary view similar to that of FIG. 3, except with certain parts exploded from the mechanism.

Referring now to FIGS. 3 and 4, certain details of the clamping mechanism 21 may be seen. The clamping mechanism 21 has a channel 56 supporting the lower plate 24 through intermediate structure to be described infra. A pair of shaft weldments 58 support channel 56. A tumble arm weldment 60 has a pair of projecting channels 62 securing shaft weldments 58 to a back plate 64 of the tumble arm weldment 60. In the embodiment of FIG. 3, frame 23 is made up of a number of pieces secured together, as described above.

Figure 3A:
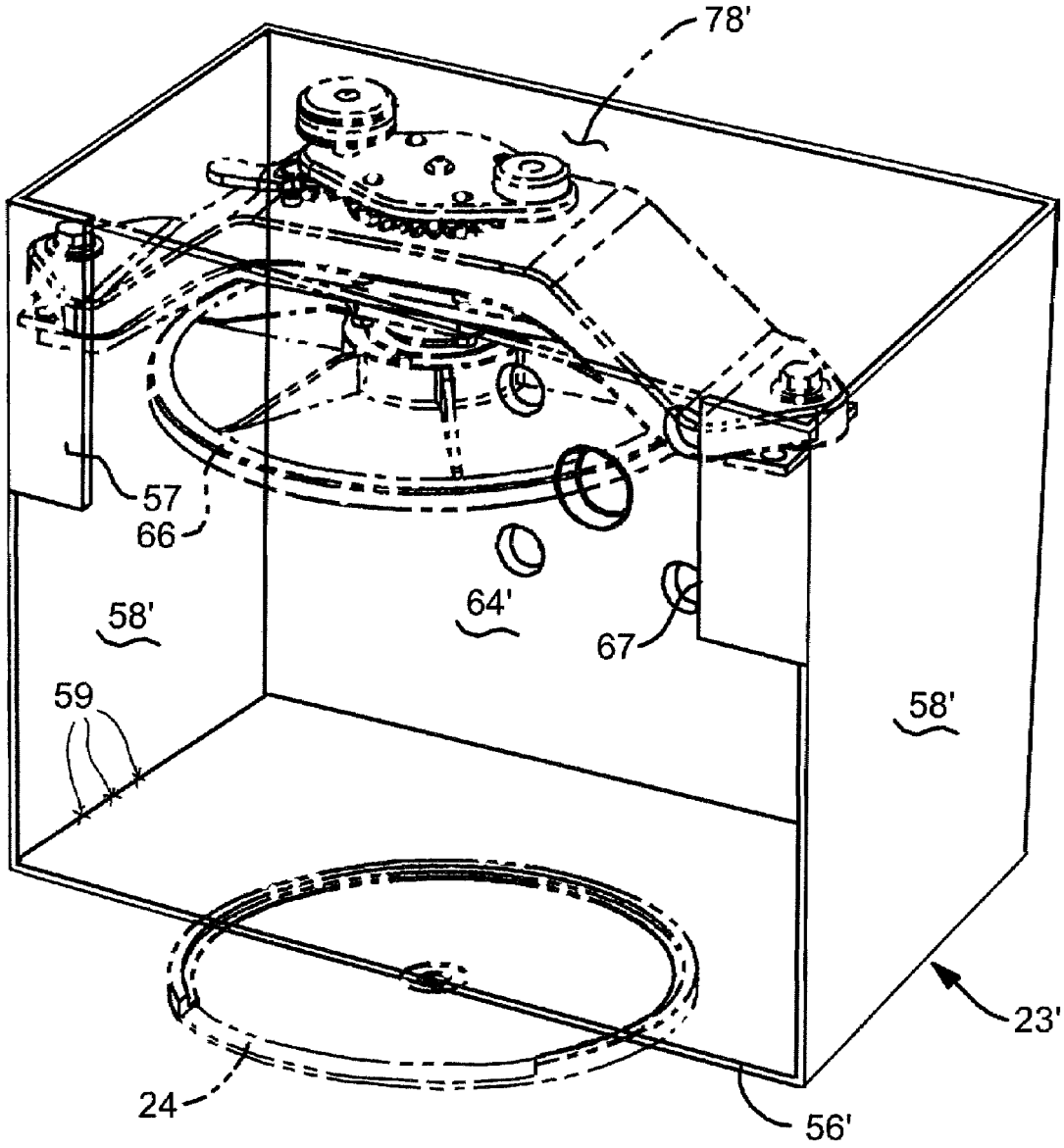
FIG. 3A is a simplified view of alternative embodiments for a unitary frame for the clamping mechanism of the present invention.

Referring now to FIG. 3A, a first alternative embodiment of a unitary frame 23' including backplate and upright portions of the clamping mechanism 21 may be seen. In this embodiment, a backplate 64' is formed from the same piece of material as upright portions 58.' Upright portions 58' may have flanges 57 to maintain alignment of the movable portion 66 of the clamping mechanism 21. As a further alternative embodiment, an extension 56' of the backplate 64' may extend under lower plate 24 in place of channel 56. Either channel 56 or extension 56' may be secured to upright portions 58' by any conventional means, such as welds 59. Similarly, as a still further alternative embodiment, the bridge 78 may be formed as an extension 78' shown in phantom in FIG. 3A as a folded top extending from and formed of the same piece of material as backplate 64' and secured by conventional means to upright portions 58.'

Figure 5:
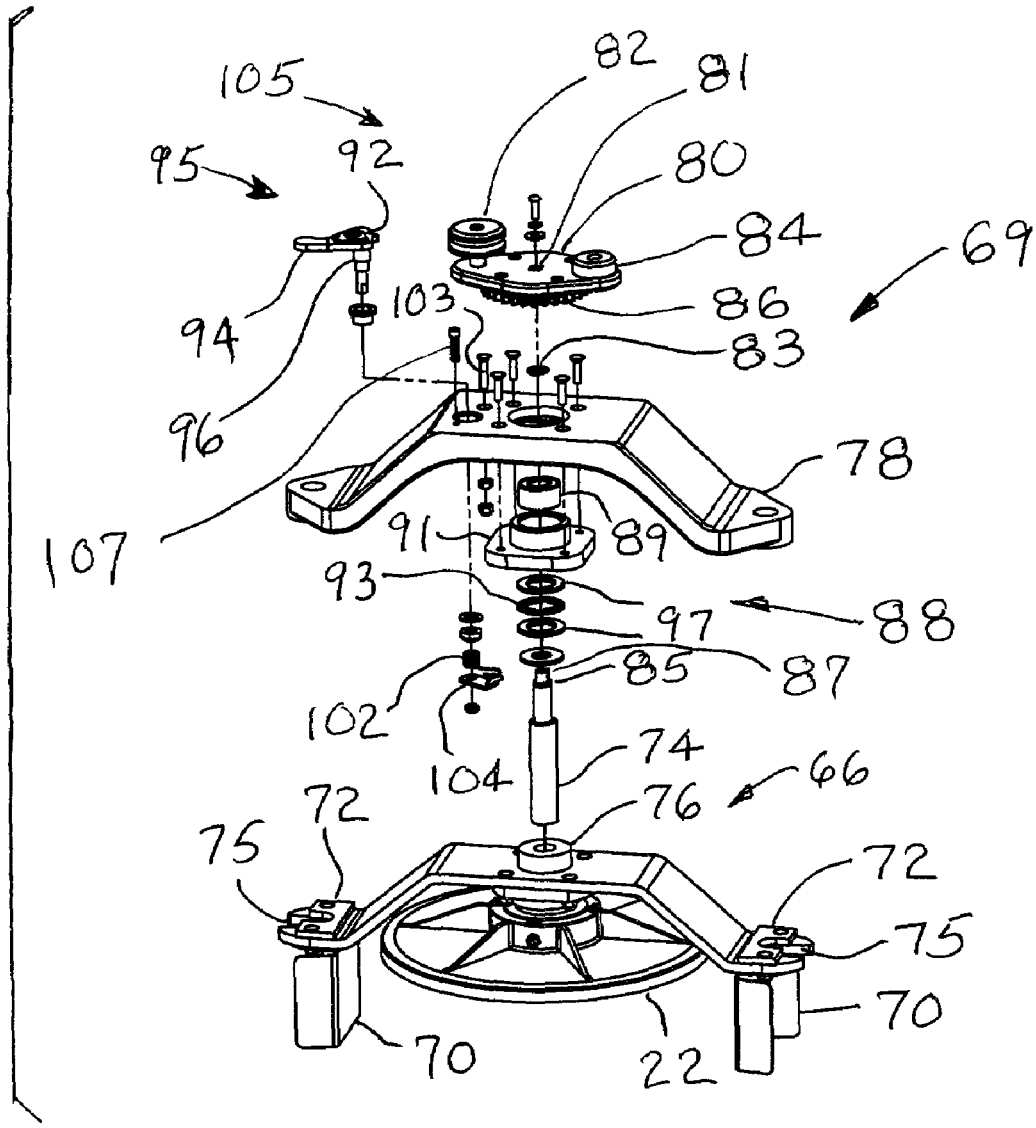
FIG. 5 is a further exploded view of certain parts of FIG. 4.
Figure 5A:
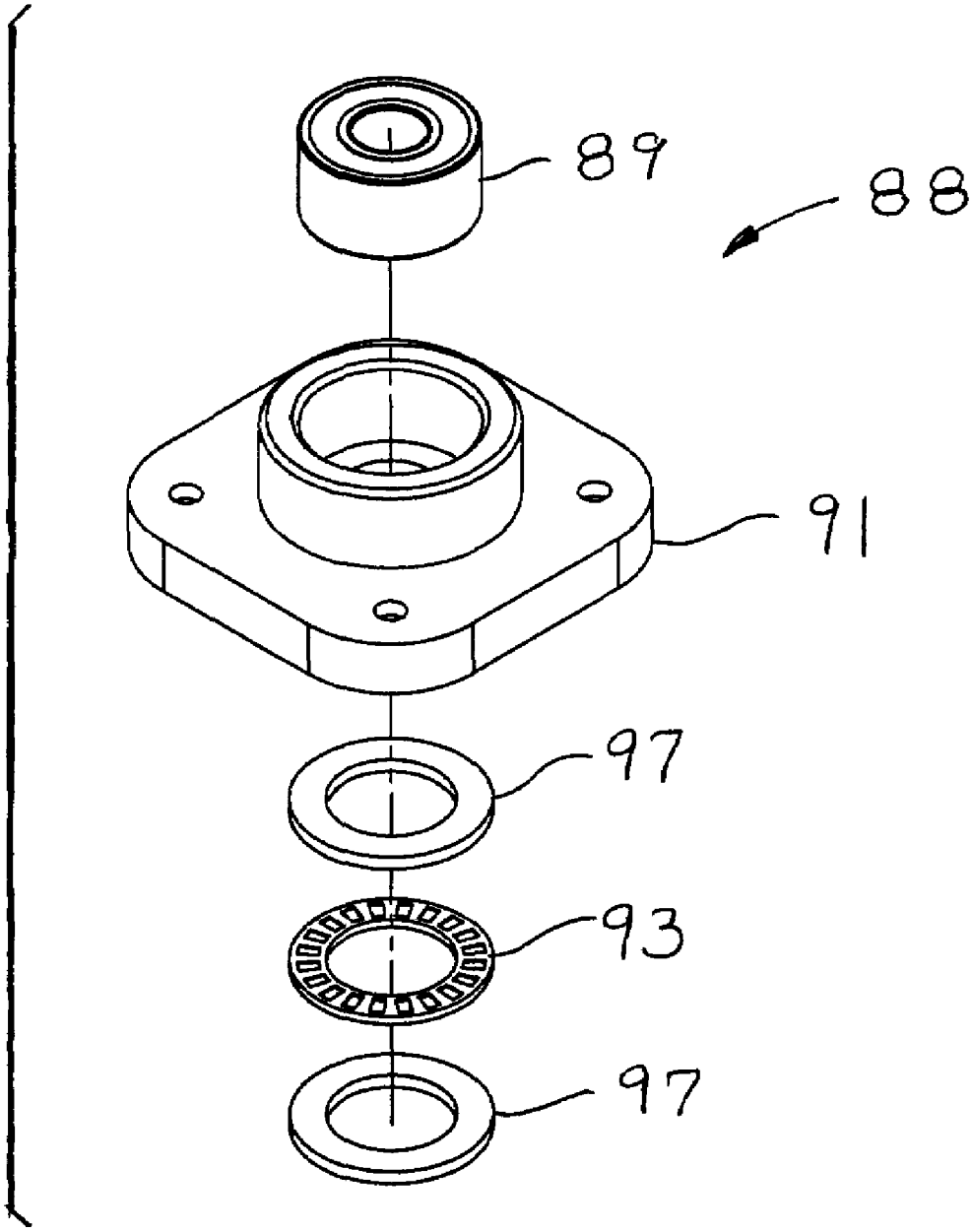
FIG. 5A is an enlarged exploded view of a bearing assembly useful in the practice of the present invention.

An upper clamp mechanism or yoke assembly 66 includes a movable cross member 68, top plate 22, a pair of paint splash guards 70, a pair of polymer guide plates 72, a lead screw nut 76 and a bearing assembly 88 (shown in FIGS. 5 and 5A). Mechanism 66 is free to travel up and down along portions 73 of shafts 58, as controlled by a lead screw 74 turning in the nut 76 mounted in cross member 68. Upper clamp mechanism 66 is carried by an upper portion 69 of the frame 23 of the clamping mechanism 21. Lead screw 74 is rotatably mounted in a bridge 78 spanning the two shaft weldments 58. Lead screw 74 is secured to and rotatable by a wing plate 80 having a rotatable handle 82 and a fixed handle 84. A sprocket 86 is secured to wing plate 80 for rotation therewith. Wing plate 80, together with its associated handles 82 and 84, sprocket 86, and a pawl assembly 95 together form a lock 105. Lock 105 and bridge 78, together with associated parts, such as fasteners, form the upper portion 69 of rotatable frame 23.

Figure 6:
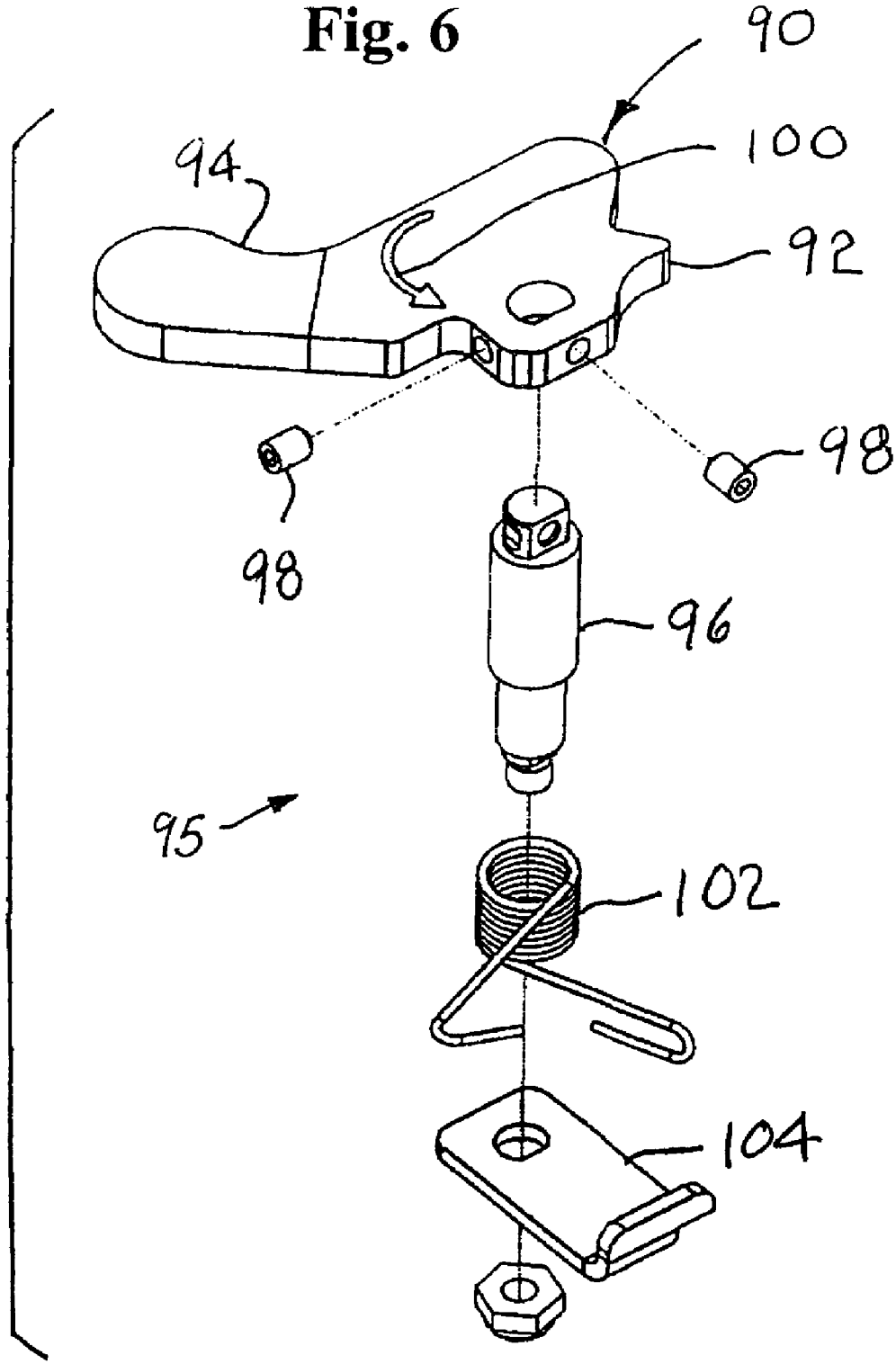
FIG. 6 is an exploded detail view of a pawl assembly for a locking mechanism useful in the practice of the present invention.

Referring now also to FIGS. 5, 5A and 6, the bearing assembly 88 supports lead screw 74 on bridge 78. A retaining ring 83 is received on a retaining ring groove 85 located just below a square shaped end 87 on lead screw 74. A mating square shaped hole 81 for receiving end 87 is located in wing plate 80. Referring most particularly to FIG. 5A, the bearing assembly 88 includes a sealed double row anti-friction ball bearing 89 for radial loads, a bearing bracket 91, and an anti-friction roller bearing 93 and associated thrust washers 97 for axial thrust loads imposed on the lead screw or centrally-located threaded rod 74. Referring now most particularly to FIG. 6, a pawl assembly 95 includes a pawl shaft 96, a spring 102, a bracket 104 and a pair of set screws 98, along with a manually releasable pawl 90 having a tooth 92. Referring now again also to FIGS. 4 and 5, tooth 92 has an involute-like profile and is biased into engagement with sprocket 86 (which also has involute-like teeth) but allows wing plate 80 to rotate in the direction of advancing the lead screw 74, tightening the clamping mechanism 21. When it is desired to retract the lead screw 74 to loosen the clamping mechanism 21, a pawl handle 94 of the pawl assembly 95 is grasped and used to rotate pawl 90 until the tooth 92 is out of engagement with sprocket 86, allowing reverse rotation of the wing plate 80, preferably via handle 82. Pawl 90 is secured to the rotatable pawl shaft 96 by the pair of set screws 98 (see FIG. 6) and pawl 90 is biased in the direction opposite arrow 100 (see FIG. 7) by the spring 102 carried on pawl shaft 96 and acting against the bracket 104 also carried on pawl shaft 96. Spring 102 reacts against a threaded fastener 103 secured to bridge 78. A second threaded fastener 107 acts as a stop to limit the degree of rotation of pawl assembly 95.

Figure 7:
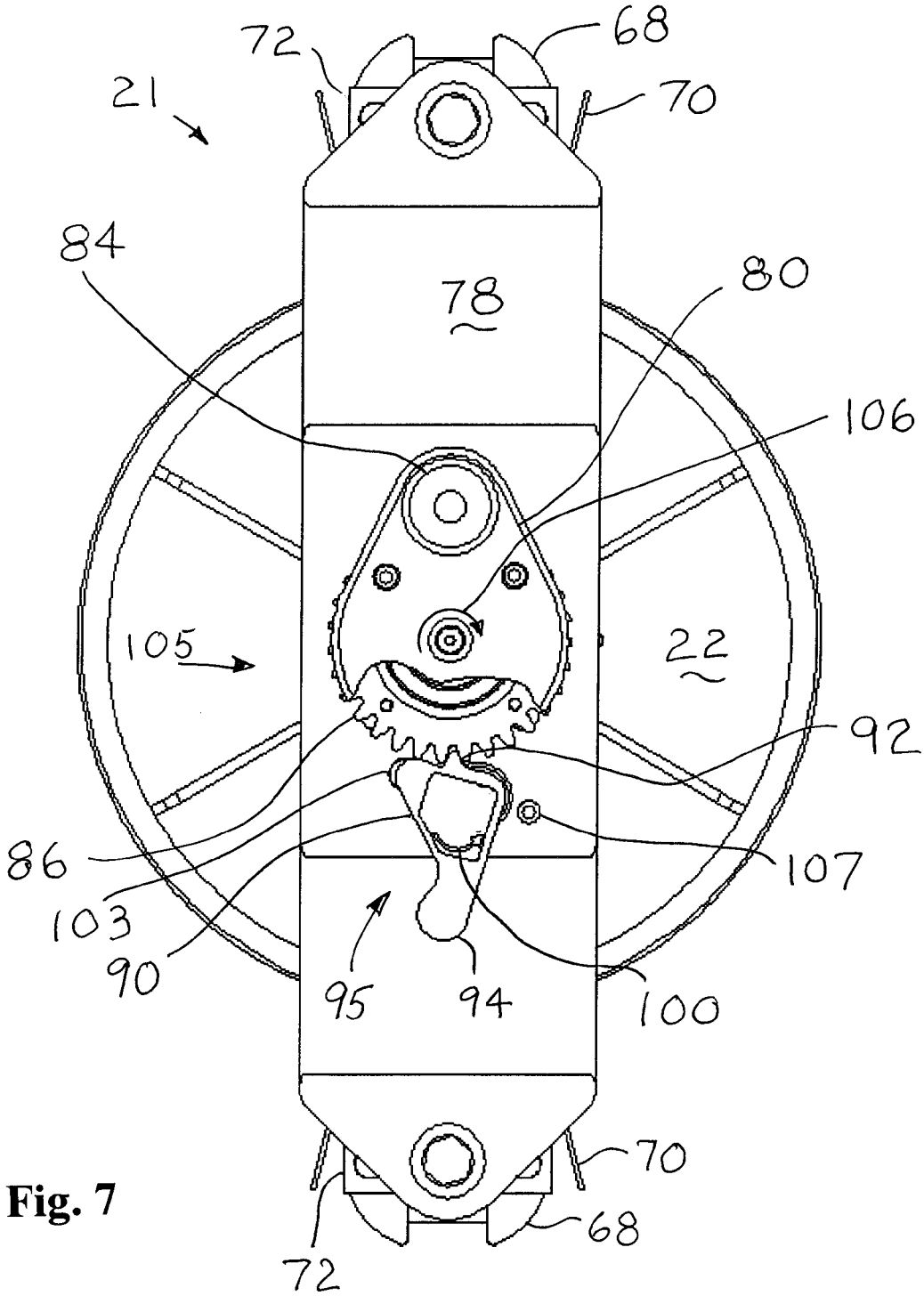
FIG. 7 is a top plan view of the parts shown in FIG. 3 in a first position.
Figure 8:
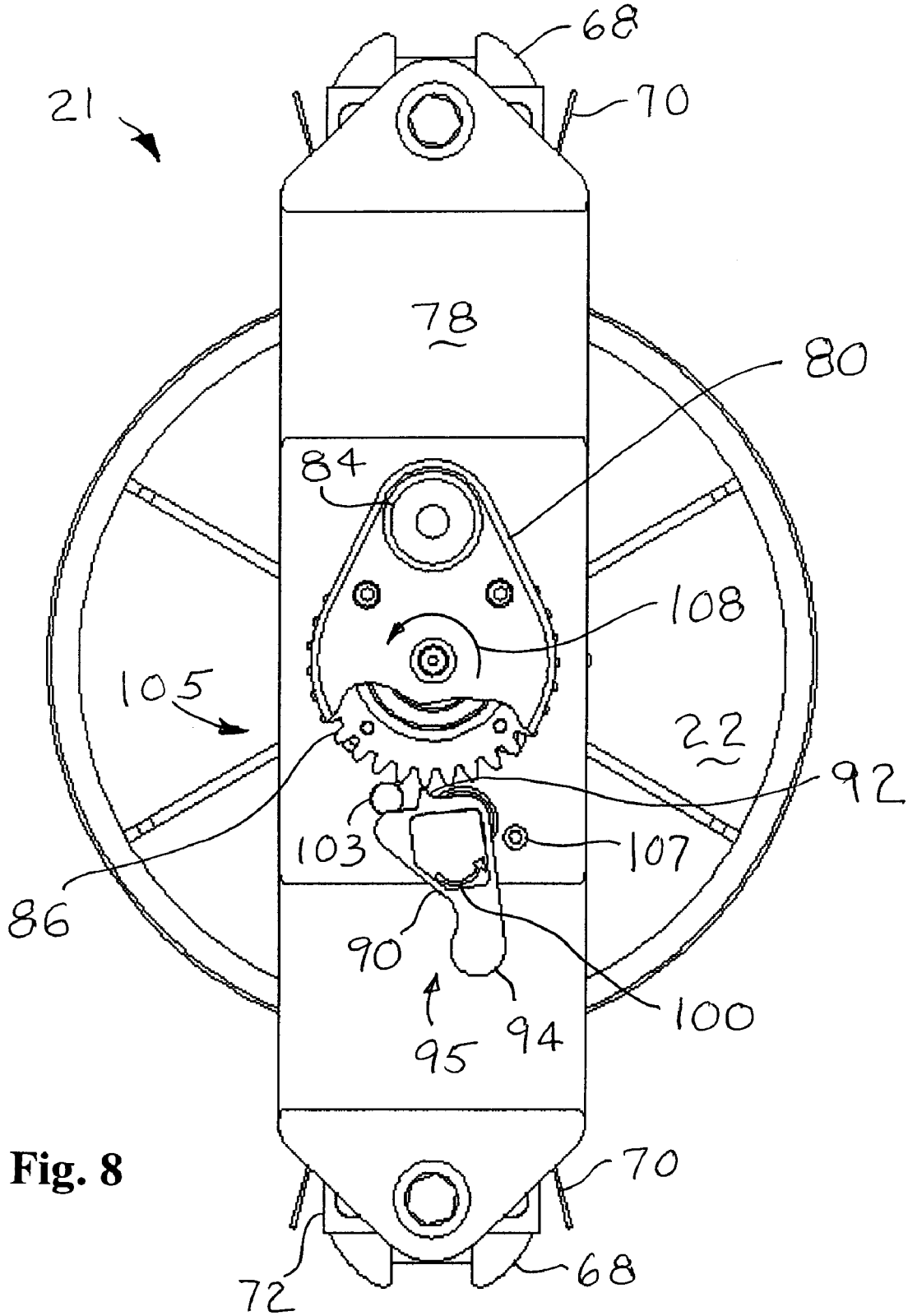
FIG. 8 is a view similar to that of FIG. 7, except with parts shown in a second position.

Referring now also to FIGS. 7 and 8, the parts of a selectively releasable lock 105 (including pawl assembly 95 and wing plate 80) for the clamping mechanism 21 may be seen in plan view in two operating positions. Lock 105 has a first state shown in FIG. 7 preventing retracting movement of the second plate 22 with respect to the first plate 24 and permitting advancing movement of the second plate 22 with respect to the first plate 24. In FIG. 7, wing plate 80 is cutaway to show the engagement of tooth 92 with sprocket 86. As wing plate 80 is rotated in the direction of arrow 106, sprocket 86 drives the pawl 90 to rotate in the direction of arrow 100 until the tooth 92 is clear of the sprocket 86, permitting clamping force to be applied to a paint container (with or without an adapter) located between plates 22 and 24. It is to be understood that pawl 90 will ratchet against sprocket 86 as rotation of wing plate 80 continues. Initially, rotatable handle 82 may be used in a single-handed fashion, if desired, to rapidly rotate wing plate 80 to advance plate 22 towards a top of a paint container resting on plate 24. Once plate 22 comes into contact with the top of the paint container, fixed handle 84 may be used along with movable handle 82 in a two-handed fashion to snugly seat plate 22 against the top of the paint container to securely clamp the paint container using the clamping mechanism 21.

If wing plate 80 is urged in the direction opposite that of arrow 106 without releasing the pawl 90, the lock 105 will prevent release of the clamping force previously applied to the paint container located between plates 22 and 24. Once the paint container is securely clamped, the mixer is preferably operated to mix the contents of the paint container with a spinning and tumbling motion.

When it is desired to remove the paint container from the clamping mechanism 21, the lock 105 is released, and the wing plate rotated to retract plate 22 from the top of the paint container. Lock 105 is released by manually moving the pawl 90 to at least the position shown in FIG. 8, where pawl 90 is shown with tooth 92 clearing the sprocket 86. FIG. 8 illustrates a second state for lock 105 permitting retracting movement of the second plate 22 with respect to the first plate 24. To maintain lock 105 in the second state it is to be understood that pawl handle 94 must be manually grasped and pawl 90 moved in the direction of arrow 100 to at least the position shown in FIG. 8, where the tooth 92 is clear of the sprocket 86, permitting wing plate 80 to be rotated in the direction of arrow 108, releasing the clamping mechanism 21. It is to be understood that if pawl 90 is moved further than as shown in FIG. 8 such that there is clearance between tooth 92 and sprocket 86, lock 105 will still be in the second state, i.e., the state permitting release of the clamping mechanism 21.

It may thus be seen that when lock 105 is in the first state, pawl 90 is biased into engagement with sprocket 86, permitting clamping motion and preventing releasing motion. When lock 105 is in the second state, pawl 90 is manually urged out of engagement with sprocket 86, permitting releasing motion of the clamping mechanism 21.

Again referring also to FIGS. 3 and 4, the paint guards 70 respectively shield each of a reduced diameter portion 73 of the shaft weldments 58 that provide a range of travel for the movable part 66 of the clamping mechanism 21. If paint were allowed to accumulate on these portions of the shaft weldments 58, it would subject the movable upper clamp mechanism 66 to the possibility of uneven loading, due to one side or the other binding between the mechanism 66 (more particularly, the guide plate 72) and a reduced diameter portion 73 of the shaft weldments 58. In other words, the paint guards 70 keep the reduced diameter portions 73 (which correspond to the range-of-travel for the upper clamp mechanism 66) clean and free of paint that may escape from a lid or bung of a coating container when the mixer 20 is operated. Each paint guard 70 may have a flange 71 with an aperture 79 having a diameter slightly larger than a diameter of portion 73 and smaller than a diameter of portion 58 below a step 77. Contact between flange 71 and step 77 on shaft weldment or upright member or portion 58 prevents further downward travel of the clamping mechanism 21 to provide a stop or limit to motion of the movable part 66 at the end of the range-of-travel when flange 71 contacts step 77.

The guide plates 72 provide a low-friction interface between the upper clamp mechanism 66 and each of the range-of-travel portions 73 of shaft weldments 58. It is to be understood that each of the guide plates 72 have a U-shaped cutout 75 that closely interfits with the reduced diameter portion 73 of shaft weldments 58. Guide plates 72 are formed of a polymer, preferably acetal or UHMW polyethylene. Referring to FIGS. 3 and 4, it can thus be seen that the pair of polymer guide members 72 are secured to cross member 68, with each of the guide members 72 in contact with a respective one of the upright members or portions 58 for reducing noise and friction that could otherwise result from contact with at least one of the upright members or portions.

Figure 9:
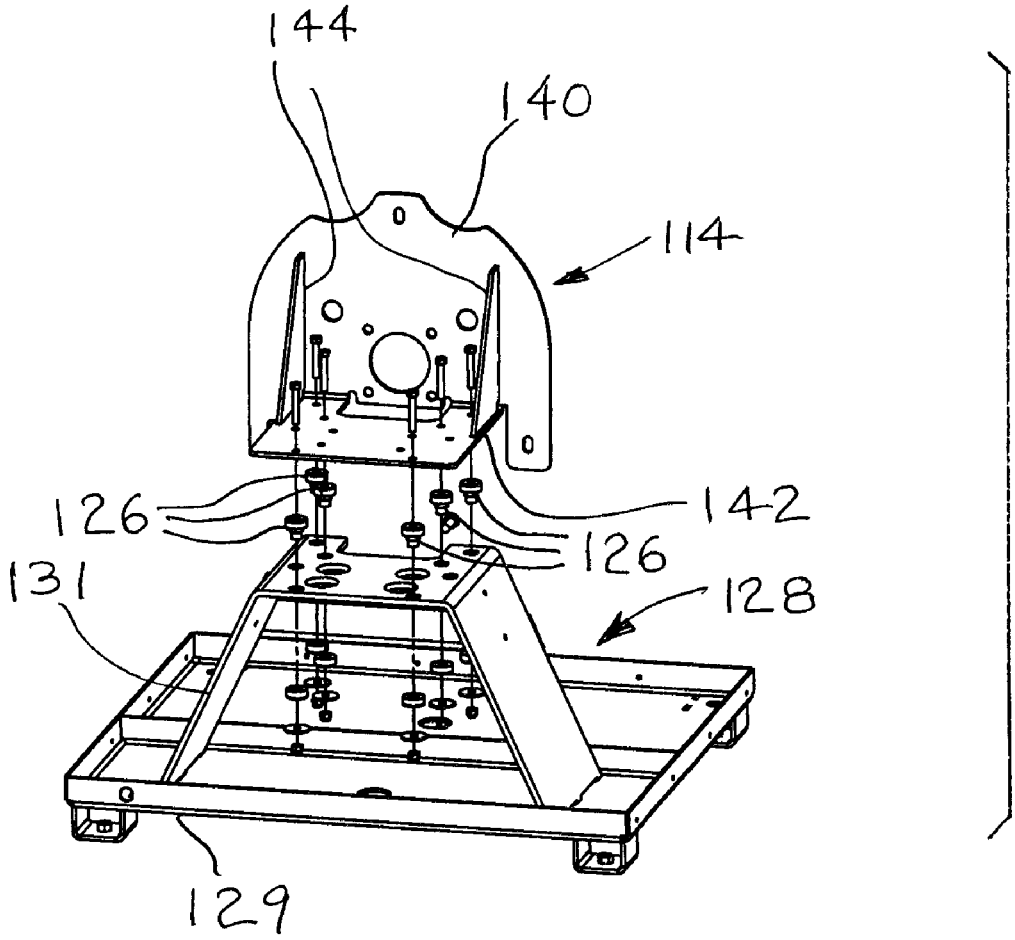
FIG. 9 is a view from the back of a base and mounting structure for the mixer of the present invention.
Figure 10:
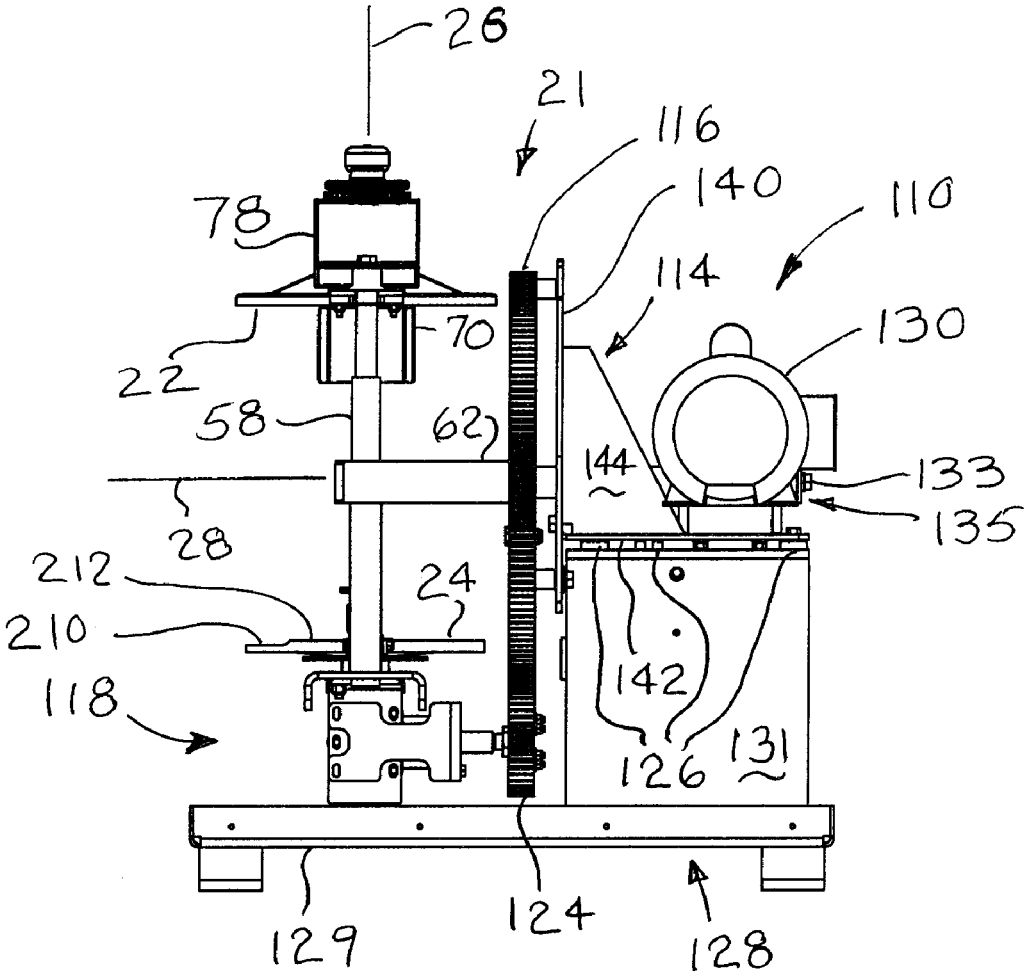
FIG. 10 is a side view of certain parts of the mixer of the present invention showing mounting details thereof.
Figure 11:
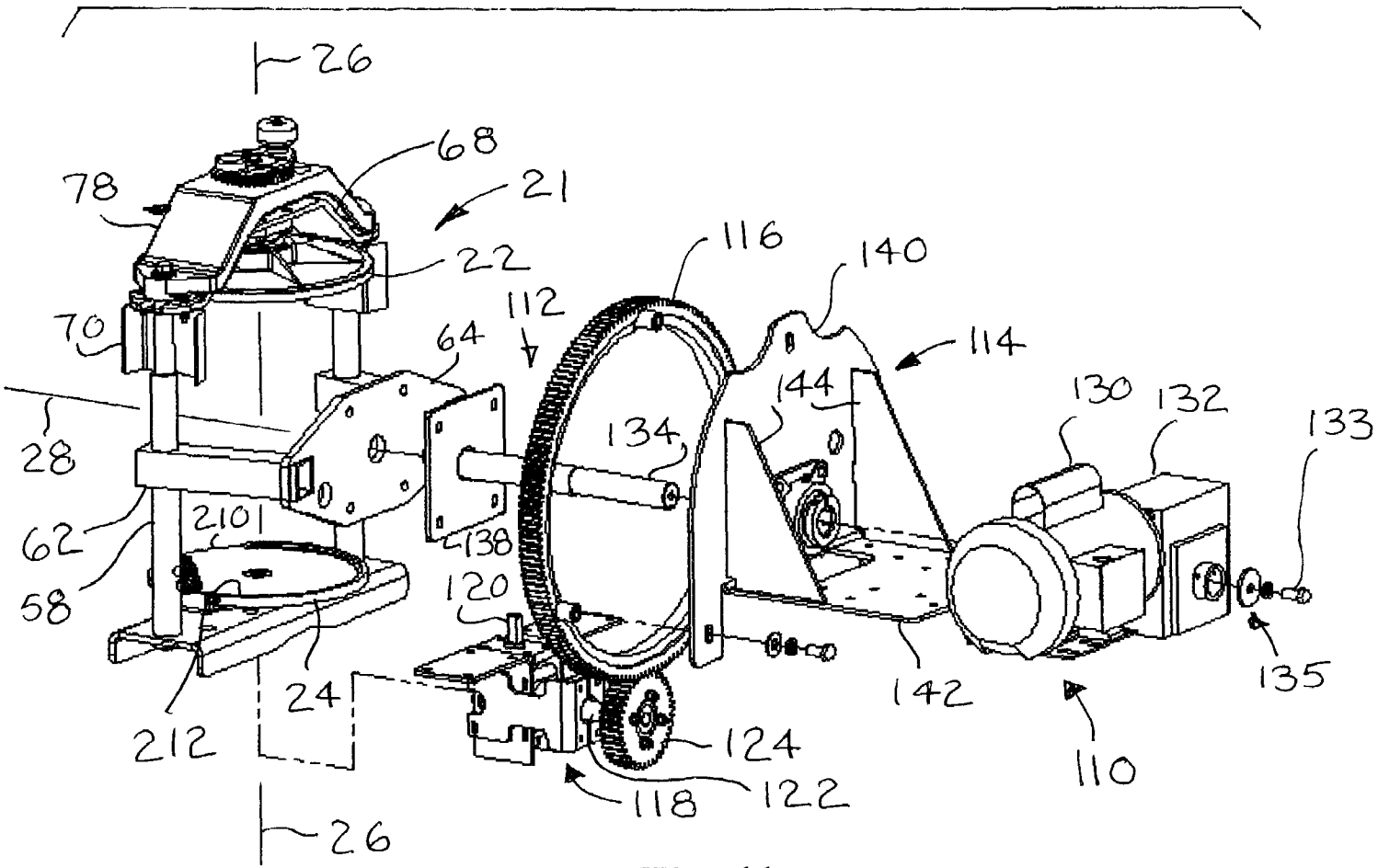
FIG. 11 is an exploded view of certain parts from FIG. 10 showing the relationship of drive train parts of the present invention.

Another aspect of the mixer 20 may be seen with respect to FIGS. 9, 10 and 11. In this aspect, the paint mixer includes a main drive 110 having an output 112 connected to the rotatable frame 23 to rotate the frame about the first axis 28 with the main drive rigidly mounted on a common base 114 to which a stationary gear 116 is rigidly mounted. The mixer 20 also includes a gear box or gear train 118 mounted on the rotatable frame 23 with an output 120 connected to the first plate 24 to rotate the first plate about the second axis 26. The gear train has a gear ratio between the rotations of the frame 23 about the first axis 28 and the rotations of the first plate 24 about the second axis 26 in a fixed ratio. The gear train also has an input 122 connected to a planet gear 124 engaged with the stationary gear 116 such that the rigid mounting of the main drive 110 and stationary gear 116 to the common base 114 maintains a desired engagement between the stationary gear 116 and the planet gear 124. Suitable vibration dampers 126 may be located between the common base 114 and a main base assembly 128 of the mixer 20. Main base assembly may include a generally pan-shaped lower portion 129 and a bridge-shaped upper portion 131, with the lower and upper portions secured together, such as by welding. The main drive 110 thus provides a means for rotating the frame 23 about the first axis 28 within the enclosure or housing 34; and the gear box 118 provides means for spinning a paint container about the second axis 26, which is perpendicular to the first axis 28.

The main drive 110 may have an electric motor 130 and a right angle gear reducer 132 to drive output 112 connected to the frame 23. The output 112 may have a shaft 134 supported by a flanged bearing 136 and by gear reducer 132. It is to be understood that shaft 134 extends into gear reducer to be driven therefrom and is secured thereto by a threaded fastener 133 and washers 135. Shaft 134 carries a drive plate 138 for attachment to the back plate 64 of the clamping mechanism 21. Bearing 136 is mounted on common base 114. Common base 114 has a vertical portion 140 and a horizontal portion 142, and may have gussets 144 welded to portions 140 and 142 to stiffen the common base 114. Motor 130 and gear reducer 132 are mounted on the common base 114. Bearing 136 is preferably secured to shaft 134 by a conventional squeeze clamp type attachment.

Figure 12:
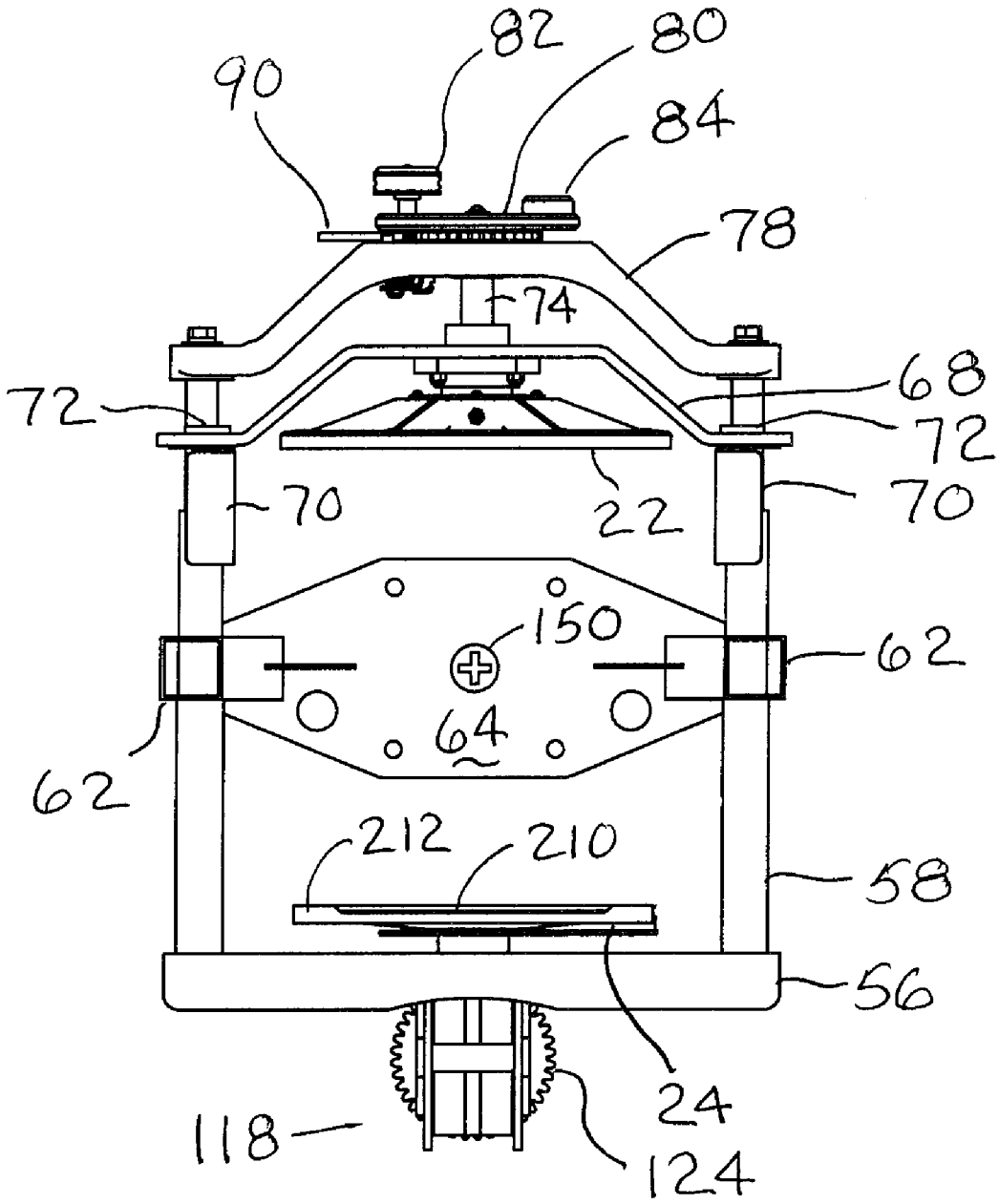
FIG. 12 is a front view of the clamping mechanism.
Figure 13:
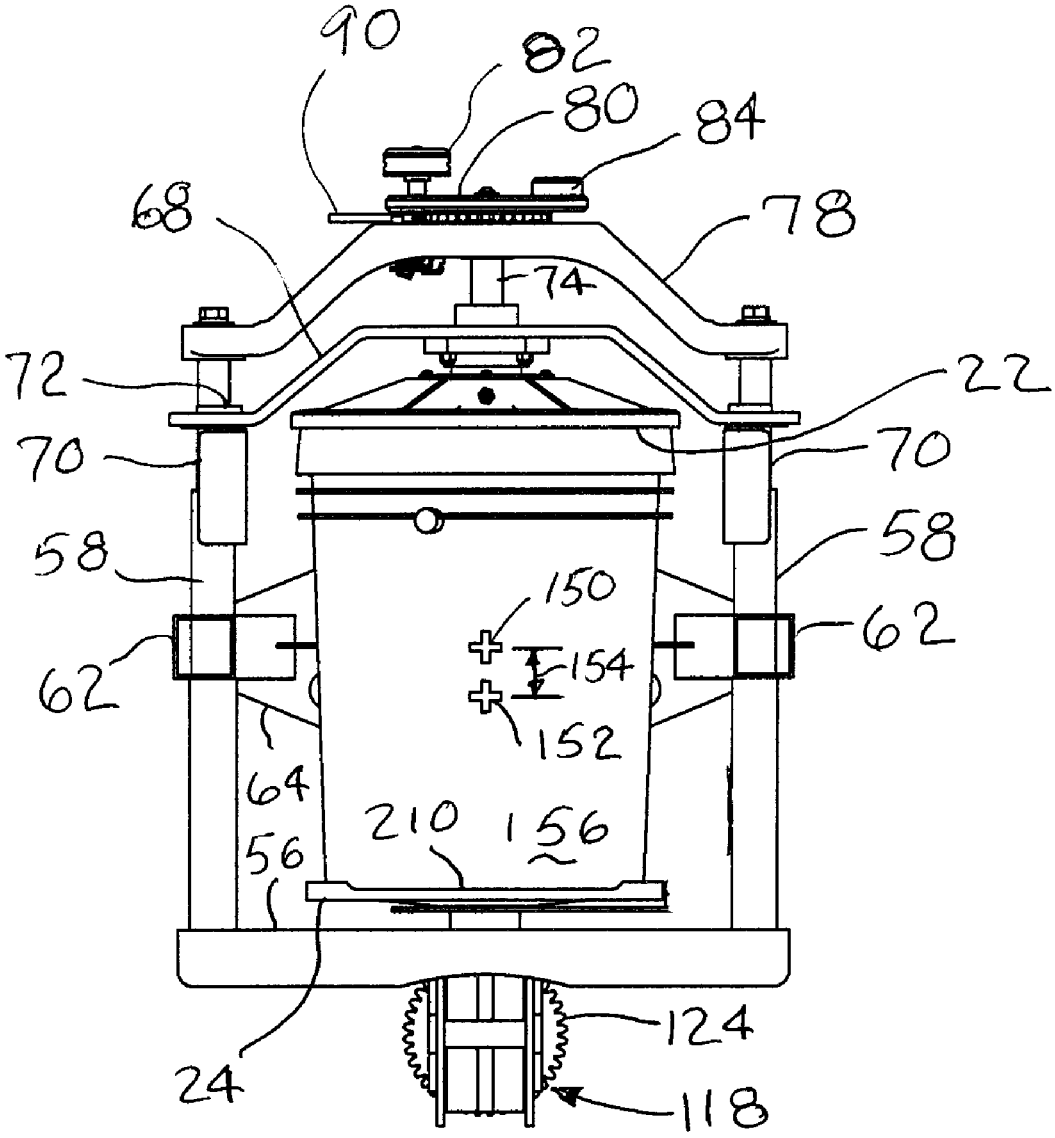
FIG. 13 is a view similar to that of FIG. 12, except showing a 5 gallon container received in the clamping mechanism, and illustrating the center of rotation and center mass of the container and clamping mechanism.

Referring now most particularly to FIGS. 12 and 13, another aspect of the present invention may be seen. In FIGS. 12 and 13 a cross 150 indicates the center of rotation for the tumble axis 28. In FIG. 13, a cross 152 indicates the center of gravity of the rotatable clamping mechanism 21 (including frame 23) and one type of conventional paint container such as a conventional five gallon cylindrical container 156. It is to be understood that in the practice of the present invention the location of the assembly and container center of gravity indicated by cross 152 is desirably located below cross 150 by an offset distance 154. The offset distance 154 will vary, depending upon the size, shape and type of container and the mass of the coating material contents of the container 156. For example mixer 20 is suitable for mixing paint in polymer or metal containers, which are known to have different aspect ratios, i.e., height to diameter ratios. Nevertheless, requiring the location of the center of gravity 152 of the combination of the clamping mechanism 21 and container clamped in the frame 23 to be below the center of rotation 150 for the tumble axis 28 (when the container and frame are in an upright position) will, as a result, allow the rotatable clamping mechanism 21 (including frame 23) to come to rest with the paint container 156 in a generally upright position after mixing, as shown in FIG. 13, when the container 156 is clamped between plates 22 and 24 regardless of the size, type, shape or material of the container or the mass of the coating contents, and whether or not an adapter is used (for example, to hold a special shaped or sized container).

The main drive 110 provides a first means for rotating the frame 23 of clamping mechanism 21 about the first axis 28 within the enclosure or housing 34; and the gear box or gear train 118 provides a second means for spinning the paint container 156 about the second axis 26, which is perpendicular to the first axis 28. As described above, the frame 23 is offset by the distance 154 with respect to the first axis 28 such that the frame 23 will come to rest with the paint container 156 in a generally upright position after mixing.

Figure 14:
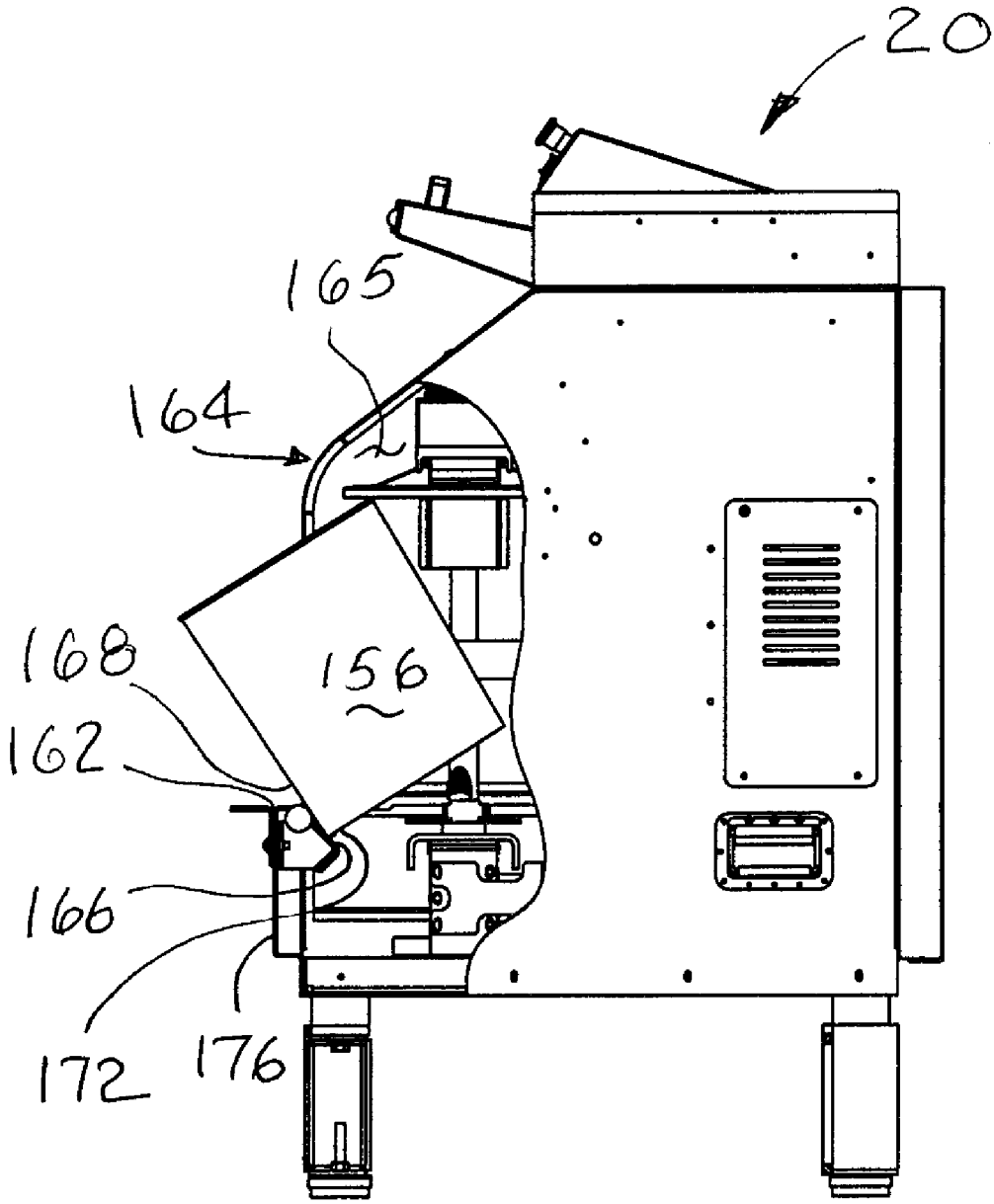
FIG. 14 is a simplified side view of the mixer of the present invention partially cut away to illustrate certain loading and unloading features of the mixer of the present invention.
Figure 15:
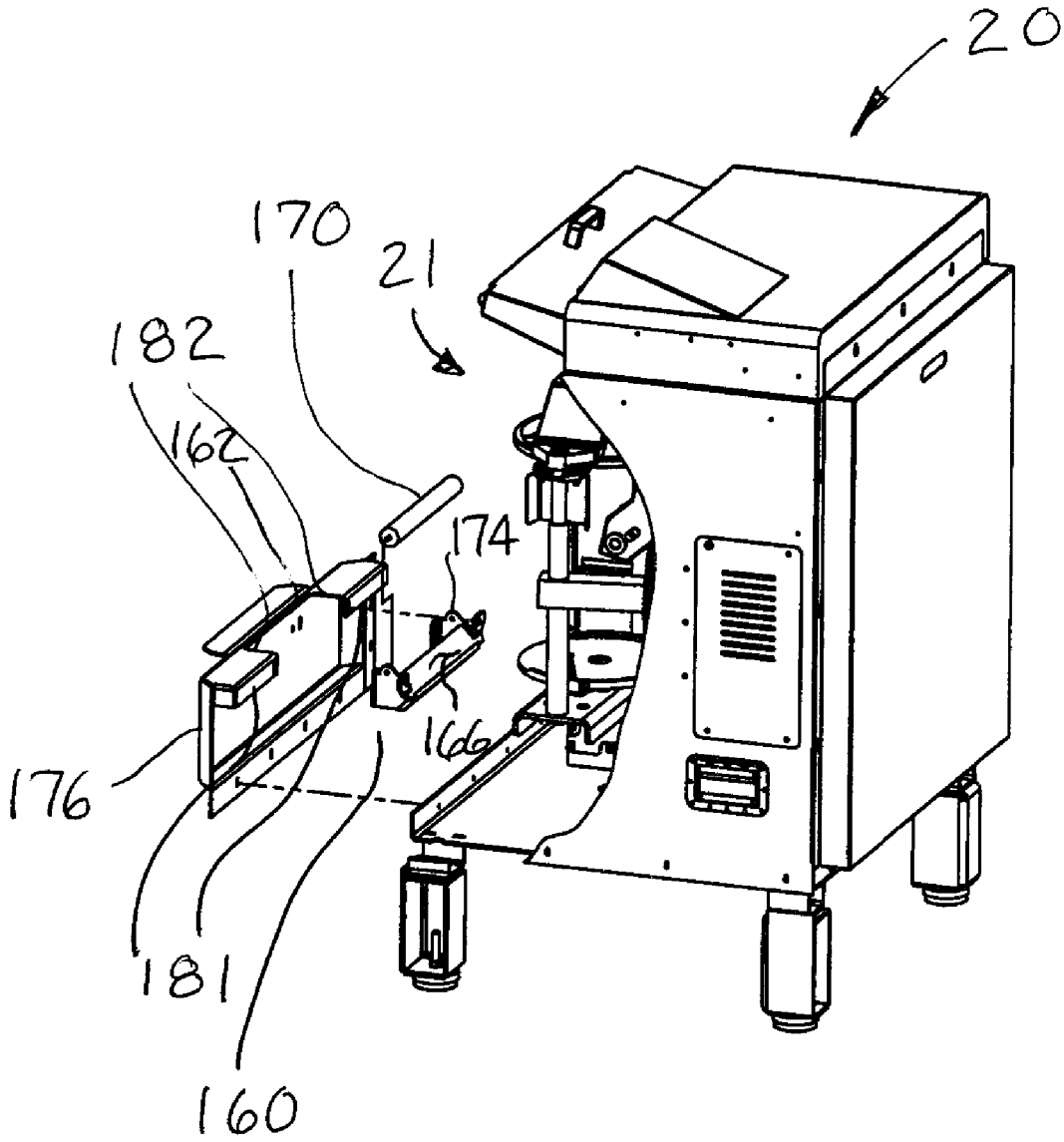
FIG. 15 is a perspective view similar to that of FIG. 14, with some parts cut away and other parts exploded.
Figure 16:
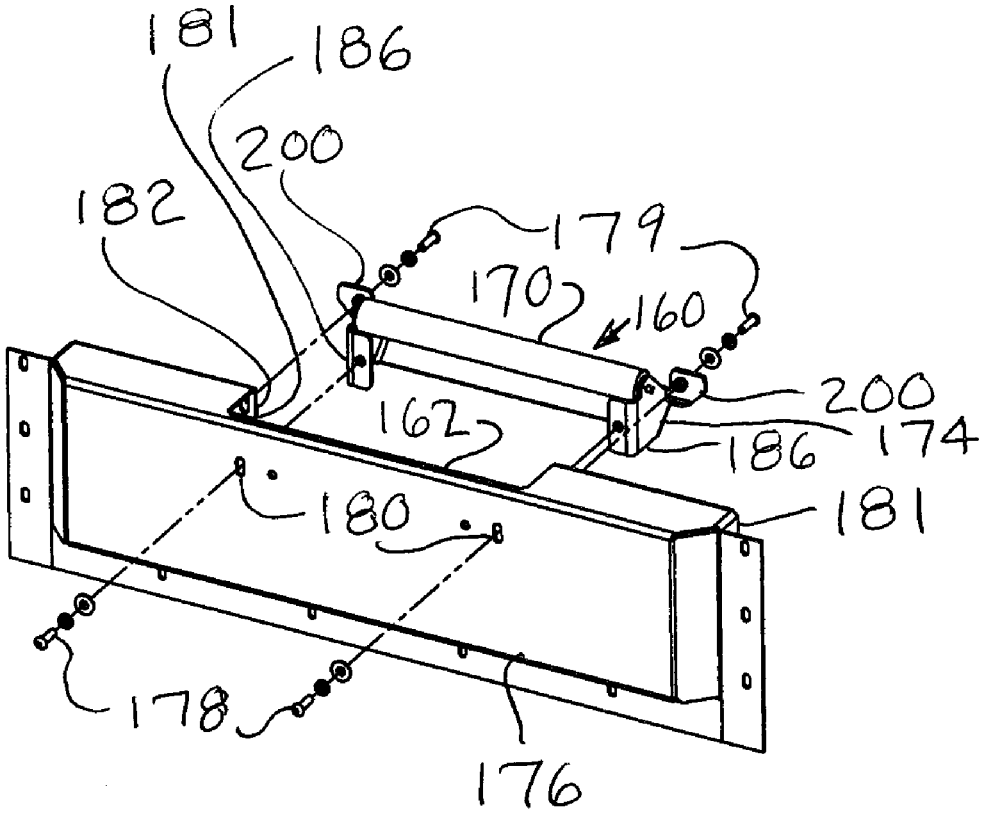
FIG. 16 is a detail view showing a lower front panel of the mixer showing details of parts to be mounted thereon.
Figure 17:
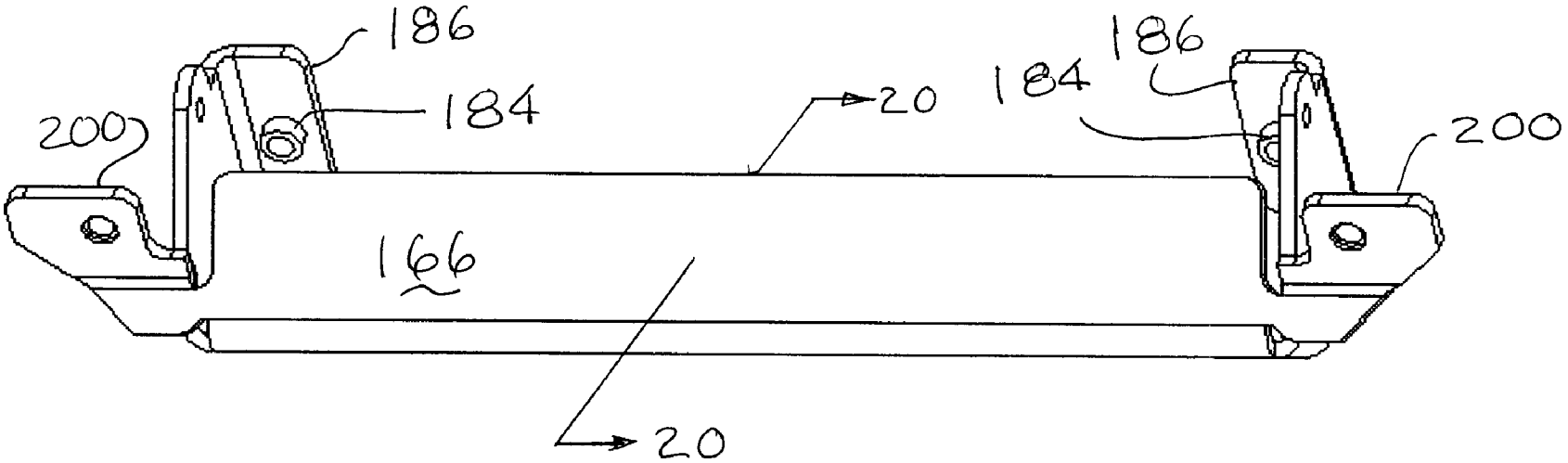
FIG. 17 is a perspective view of a strike plate bracket useful in the practice of the present invention.
Figure 18:
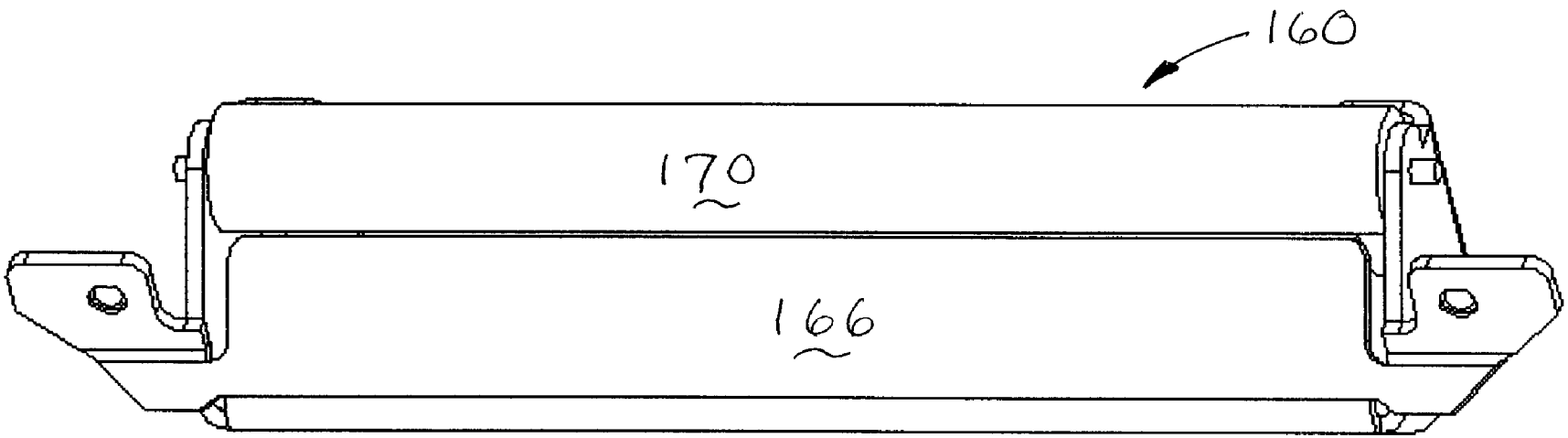
FIG. 18 is a perspective view of the strike plate bracket of FIG. 17, with a roller attached thereto, forming a strike plate assembly.
Figure 19:
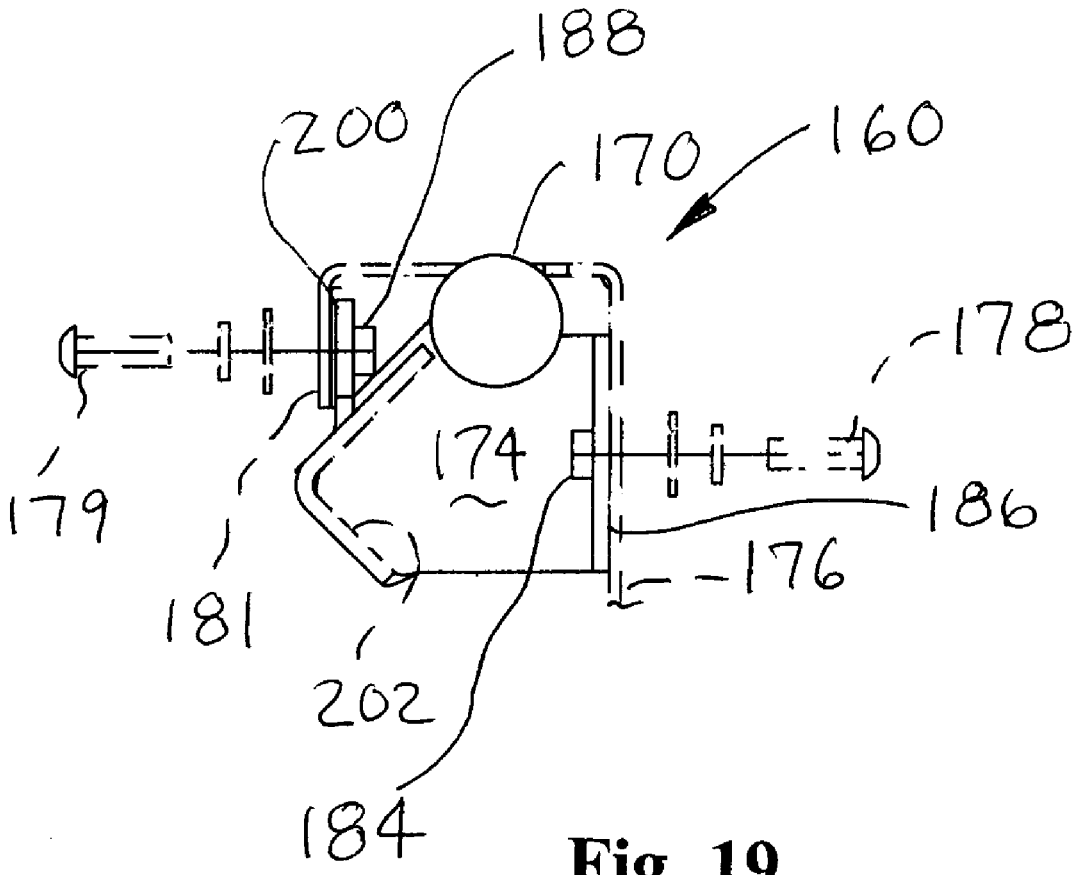
FIG. 19 is a side view of the strike plate assembly of FIG. 18.
Figure 20:
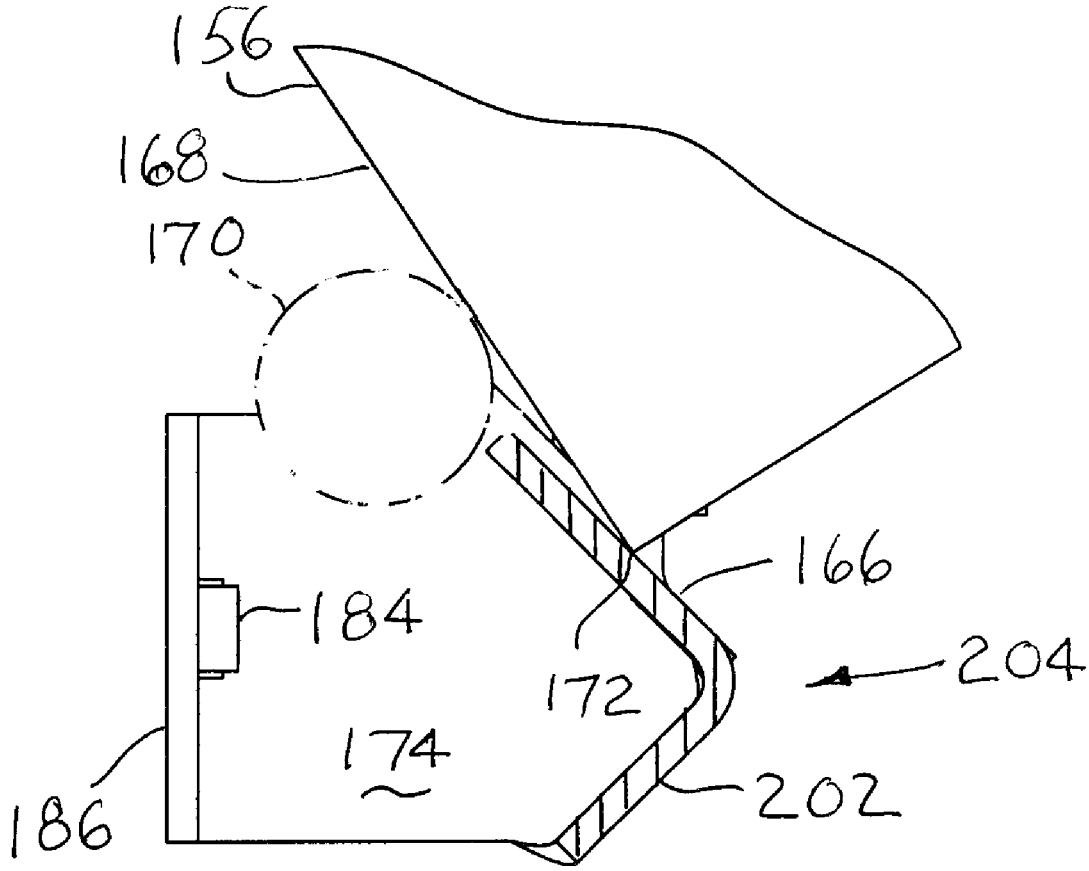
FIG. 20 is a section view of the strike plate bracket taken along line 20—20 of FIG. 17.

Referring now to FIGS. 14 through 20 a still further aspect of the improved paint mixer 20 of the present invention may be seen. A strike plate assembly 160 is located at a lower edge 162 of an opening 164 in the enclosure 34 for loading and unloading the paint container 156 with respect to the mixer 20. The strike plate assembly 160 includes a strike plate 166 located generally at or below the lower edge 162 of the opening 164 and facing an inside 165 of the mixer 20 for receiving the impact of the paint container 156 as it is unloaded from the paint mixer 20, as shown in FIG. 14. Without the strike plate 166, it is to be understood that a side 168 of the paint container 156 may easily be dented (when the container is made of metal) upon impact with a roller 170 located above the strike plate 166 for transferring the paint container 156 into and out of the mixer 20. As may be seen most clearly in FIGS. 14 and 20, the strike plate 166 contacts the bottom edge 172 of the paint container 156, and prevents the side 168 from becoming dented when the paint container 156 is tilted as shown in FIG. 14 while being removed from mixer 20. The strike plate 166 forms a part of a roller bracket 174 carrying the roller 170 and adjustably secured to a lower front plate 176 of the housing 34 for adjusting the height of the roller 170 and strike plate 166 forming the strike plate assembly 160. Bracket 174 is secured to front plate 176 by a first pair of screws 178 extending forward through front plate 176 and a second pair of screws 179 extending rearward through an interrupted flange 181, which is preferably formed from the same material as front plate 176. A cross section view of the relationship of the strike plate assembly 160 (including roller bracket 174) and the flanged front plate 176 is shown in FIG. 20. Height adjustment of the roller 170 may be achieved by loosening both sets of attachment screws 178, 179 and sliding the assembly 160 vertically with respect to slots 180, 182 and then tightening screws 178, 179. In FIGS. 15 and 16, slots 182 may be seen. These slots receive screws (not shown) similar to screws 178. The slots 180 align with pressed in nuts 184 in front flanges 186 and slots 182 align with pressed in nuts 188 in rear flanges 200. The strike plate 166 may have a stiffener angle plate 202 for reinforcement, it being understood that strike plate 166 and stiffener angle plate 202 together make up an "L" shaped cross-section 204 as shown most clearly in FIG. 20.

Referring back to FIGS. 3 and 10–13, in another aspect of the present invention a relief 210 is formed in lower plate 24 to assist in loading and unloading paint containers on to and off of plate 24. The lower plate 24 includes a raised portion or lip 212 surrounding a portion of a periphery of the plate and the relief 210 in the raised portion 212 is sufficiently wide to enable or assist in loading and unloading the paint container on to and off of the first or lower plate 24 by permitting sliding the container through or across the relief 210 instead of having to lift the container over the lip 212. The relief 210 is oriented towards a front of the mixer when the mixer is stopped. This is accomplished by providing an integer gear ratio and synchronizing the timing of rotation about spin axis 26 with the tumble axis 28 such that the relief 210 is forward facing each time the rotatable frame 23 of clamping mechanism 21 reaches an upright position, as shown in FIGS. 12 and 13. The number of teeth in the stationary gear 116 and in the planet or spur gear 124 and the ratio of gear train 118 set the ratio of the spin and tumble revolutions and the positioning of the spur gear 124 with respect to the stationary gear 116 (once the ratio of gear train 118 is fixed) may be used to synchronize the timing of the spin and tumble rotational movements.

The invention is not to be taken as limited to all of the details thereof as modifications and variations thereof may be made without departing from the spirit or scope of the invention.

What is claimed is:

1. A paint mixer comprising:

a. a housing; and b. a rotatable frame within the housing, the frame having i. a base portion supporting a first plate for receiving a paint container, ii. a pair of upright portions extending from the base member, iii. a bridge portion extending between the upright portions, iv. a movable clamp assembly extending below the bridge portion and positioned between the upright portions and having a centrally-located threaded rod extending through the bridge portion and directly connected at one end to a rotatable handle and at the other end to a second plate for advancing and retracting the second plate with respect to the first plate in opposed relationship thereto for clamping a paint container between the first and second plates, and v. a selectively releasable lock including a pawl assembly located in a stationary position on the bridge portion wherein the lock has a first state preventing retracting movement of the second plate with respect to the first plate while permitting advancing movement of the second plate with respect to the first plate and having a second state permitting retracting movement of the second plate with respect to the first plate.

2. The paint mixer of claim 1 wherein the pawl assembly further includes a pawl handle pivotably mounted directly on the bridge portion.

3. The paint mixer of claim 2 wherein the pawl handle is resiliently biased with respect to the bridge portion.

4. The paint mixer of claim 1 wherein the lock further includes a rotatable sprocket selectively engageable with the pawl assembly.

5. The paint mixer of claim 4 wherein the sprocket includes involute-like gear teeth.

6. The paint mixer of claim 5 wherein the pawl assembly includes an involute-like tooth.

7. The paint mixer of claim 1 further comprising a bearing assembly including a radial bearing and an axial thrust bearing supporting the centrally located threaded rod against radial and axial loads.

8. The paint mixer of claim 1 wherein the frame further comprises a backplate and the pair of upright portions of the frame are formed as a pair of separate upright members secured to the backplate.

9. The paint mixer of claim 1 wherein the frame further comprises a backplate and at least one of the pair of upright portions of the frame are formed integrally from a common piece of material with the backplate.

10. The paint mixer of claim 9 wherein each of the pair of upright portions of the frame are formed integrally with the backplate from the common piece of material.

11. The paint mixer of claim 1 wherein the frame further comprises a backplate and the base portion is formed integrally from a common piece of material with the backplate.

12. The paint mixer of claim 1 wherein the frame further comprises a backplate and the bridge portion is formed integrally from a common piece of material with the backplate.

13. The paint mixer of claim 1 wherein the bridge portion is a separate piece secured to the upright portions.

14. The paint mixer of claim 1 further comprising:

vi. at least one polymer guide member secured to the movable clamp assembly and in contact with at least one of the upright portions, the guide member guiding the movable clamp assembly within the frame and reducing noise and friction that would otherwise result from contact between the movable clamp assembly and the at least one upright portion.

15. The paint mixer of claim 14 wherein the at least one polymer guide member comprises a pair of guide members.

16. The paint mixer of claim 14 wherein the at least one polymer guide member is formed of a relatively rigid, low friction polymeric material.

17. The paint mixer of claim 1 wherein the rotatable frame further comprises:

vi. a yoke assembly extending between the pair of upright portions and including a pair of paint splash guards, with each of the paint splash guards shielding at least a range-of-travel region of a respective one of the upright portions.

18. The paint mixer of claim 17 wherein each of the paint splash guards extends along the respective upright portion adjacent the yoke assembly.

19. The paint mixer of claim 17 wherein each of the paint splash guards have a flange providing a stop to limit travel of the yoke assembly.

20. The paint mixer of claim 19 wherein the flange has an aperture through which the range-of-travel region of the respective upright portion extends.

21. The paint mixer of claim 20 including a step in a cross section of the upright portion adjacent the range-of-travel region with a cross section greater than a cross section of the aperture wherein engagement of the step with the flange provides the stop to limit travel of the yoke assembly.

22. The paint mixer of claim 1 wherein the rotatable frame further comprises:

an axis for rotation of the frame offset with respect to the center of mass of the frame such that the frame will come to rest in a generally upright position after mixing.

23. The paint mixer of claim 22 further comprising c. a paint container received in the frame, wherein the axis for rotation of the frame offset with respect to the center of mass of the combination of the frame and paint container such that the frame will come to rest with the paint container in a generally upright position after mixing.

24. The paint mixer of claim 1 wherein the first plate further comprises:

a raised portion surrounding a portion of a periphery of the first plate and a relief in the raised portion for assisting in unloading the paint container off of the first plate.

25. The paint mixer of claim 24 wherein the relief is oriented towards a front of the mixer when the mixer is stopped and the frame is in an upright position.

26. The paint mixer of claim 1 further comprising:

c. a main drive connected to the rotatable frame to rotate the frame about a first axis concentric with a stationary gear; and d. a gear train mounted on the rotatable frame having a planet gear in engagement with the stationary gear and connected to rotate a paint container located in the frame about a second axis; and e. a common base having the main drive and stationary gear rigidly mounted thereto to maintain a desired engagement between the stationary gear and the planet gear.

27. The paint mixer of claim 26 wherein the mixer further comprises f. a main base connected to and supporting the common base via at least one vibration isolator.

28. The paint mixer of claim 1 wherein the frame rotates about a first axis and further comprising:

c. a gear train mounted on the rotatable frame for rotating a paint container in the frame about a second axis and having a gear ratio between the rotations of the frame about the first axis and the rotations of the paint container about the second axis is an integer number.

29. The paint mixer of claim 28 wherein the gear train has a timing relationship to repeatably position the paint container to a predetermined orientation with respect to the housing when the frame is in the upright position.

30. The paint mixer of claim 29 wherein the paint container rests on the first plate and wherein the first plate has a raised peripheral portion with a relief therein for loading and unloading the paint container, and the relief is positioned at the front of the mixer when the frame is in the upright position.

31. The paint mixer of claim 1 wherein the housing has an opening with a lower edge for loading and unloading a paint container with respect to the mixer; and the mixer further comprises a strike plate located below the lower edge of the opening and facing an inside of the mixer and positioned to contact a lower edge of the paint container as the paint container is unloaded from the mixer such that the side of the paint container is not dented by contact with the lower edge of the opening.

32. The paint mixer of claim 31 further comprising a roller located at the lower edge of the opening.

33. The paint mixer of claim 32 further comprising a roller bracket integral with the strike plate and supporting the roller in a predetermined location with respect to the strike plate.

34. A method of selectively positioning a paint container in a clamping frame of a paint mixer comprising the steps of:

a. inserting a paint container between a pair of clamping plates in a paint mixer; and b. advancing one plate towards the other plate using a single lead screw driven by a handle connected directly to the lead screw and having a ratcheting mechanism with a sprocket gear having involute-like teeth positively fixed to the handle and engaging a pawl assembly, wherein the ratcheting mechanism permits advance of the lead screw to secure the paint container between the pair of plates and selectively prevents retraction of the one plate with respect to the other plate.

35. The method of claim 34 further comprising the steps of:

c. manually retracting the pawl assembly from engagement with the involute-like teeth of the sprocket gear thus releasing the ratcheting mechanism and permitting retraction of the one plate away from the other plate; and d. removing the paint container from between the pair of clamping plates in the paint mixer.

36. The method of claim 34 further comprising the step of:

c. supporting the lead screw against radial and thrust loads with a bearing assembly having both radial and thrust bearings.

37. A method of mixing paint in a paint mixer comprising the steps of:

a. providing a rotatable frame for holding the paint container, with the frame and paint container having an axis of rotation and a center of mass;

b. offsetting the axis of rotation from the center of mass to permit gravity to rotate the frame and paint container to a generally upright position in the absence of another rotational force applied to the frame;

c. inserting a paint container between a pair of clamping plates in the rotatable frame; and d. advancing one plate towards the other plate using a single lead screw driven by a handle connected directly to the lead screw and having a ratcheting mechanism with a sprocket gear having involute-like teeth positively fixed to the handle and engaging a pawl assembly, wherein the ratcheting mechanism permits advance of the lead screw to secure the paint container between the pair of plates and selectively prevents retraction of the one plate with respect to the other plate;

e. applying a rotational force to the rotatable frame to mix paint in the container; and f. removing the rotation force from the rotatable frame and allowing the frame to come to rest with the paint container in a generally upright position after mixing as a result of the offset between the axis of rotation and center of mass.

38. The method of claim 37 further comprising the step of shielding a range-of-travel portion of the rotatable frame with a splash guard.

39. The method of claim 37 wherein one of the clamping plates is a lower clamping plate when the mixer is at rest, and the method further comprises providing a relief in the raised peripheral portion of the lower clamping plate; and sliding a paint container off of the lower clamping plate through the relief in the raised portion.

40. The method of claim 39 wherein the paint mixer is of the type having a geared drive connection between a tumble axis and a spin axis for mixing the contents of the paint container and wherein the method further comprises synchronizing the gearing between the tumble axis and the spin axis to orient the relief towards an opening in the paint mixer when the frame and paint container are in an upright position.

41. The method of claim 40 wherein the synchronizing of the gearing between the tumble axis and the spin axis further includes synchronizing the lower clamping plate with the rotatable frame.

42. The method of claim 34 wherein the paint mixer is of the type having an opening with a lower edge for loading and unloading a paint container with respect to the mixer, the method further including providing a strike plate located below the lower edge of the opening and facing an inside of the mixer; and contacting the strike plate with a lower edge of the paint container as the paint container is unloaded from the mixer such that the side of the paint container is not dented by contact with the lower edge of the opening.

43. The method of claim 42 wherein the lower edge of the opening includes a roller.

44. The method of claim 43 further comprising providing a roller bracket integral with the strike plate to position the roller in a predetermined location with respect to the strike plate.

45. The method of claim 41 further comprising adjustably positioning the roller bracket with respect to the opening.

* * * * *

UNITED STATES PATENT AND TRADEMARK OFFICE

CERTIFICATE OF CORRECTION

PATENT NO. : 7,165,879 B2
APPLICATION NO. : 10/809890
DATED : January 23, 2007
INVENTOR(S) : Thomas J. Midas et al.

It is certified that error appears in the above-identified patent and that said Letters Patent is hereby corrected as shown below:

Column 12

Line 26 (Claim 42), delete "34" and insert -- 37 --

Line 42 (Claim 45), delete "41" and insert -- 44 --

Signed and Sealed this

Second Day of October, 2007

JON W. DUDAS
*Director of the United States Patent and Trademark Office*